US006560944B1

(12) United States Patent
Wilson

(10) Patent No.: US 6,560,944 B1
(45) Date of Patent: May 13, 2003

(54) WOOD TRIM SYSTEM

(76) Inventor: Bryan Alexander Wilson, 272 Foucault Crescent, Espanola, Ontario (CA), P5E 1N8

( * ) Notice: Subject to any disclaimer, the term of this patent is extended or adjusted under 35 U.S.C. 154(b) by 117 days.

(21) Appl. No.: 09/661,077

(22) Filed: Sep. 13, 2000

Related U.S. Application Data

(63) Continuation of application No. 08/365,790, filed on Sep. 21, 1994, now Pat. No. 6,148,883, which is a continuation-in-part of application No. PCT/GB93/00583, filed on Mar. 22, 1983.

(51) Int. Cl.[7] ..... E04C 1/39; E06B 1/60

(52) U.S. Cl. ..... 52/717.01; 52/718.03; 52/288.1; 52/212

(58) Field of Search ..... 52/717.01, 211, 52/718.02, 204.53, 204.54, 717.04, 718.01, 718.03, 718.04, 718.05, 718.06, 179, 188, 287.1, 288.1, 212; 49/504, DIG. 1, DIG. 2

(56) References Cited

U.S. PATENT DOCUMENTS

| | | | | | |
|---|---|---|---|---|---|
| 3,609,928 | A | * | 10/1971 | Mock | 52/717.01 |
| 3,974,606 | A | * | 8/1976 | Laborde | 52/288 |
| 4,423,575 | A | * | 1/1984 | Lagergren et al. | 52/211 |
| 4,614,068 | A | * | 9/1986 | Bergthold | 52/211 |
| 5,359,817 | A | * | 11/1994 | Fulton | 52/288.1 |
| 5,463,835 | A | * | 11/1995 | Wood | 52/288.1 |
| 5,528,869 | A | * | 6/1996 | Boomer et al. | 52/212 |
| 5,551,201 | A | * | 9/1996 | Anderson | 52/717.05 |
| RE35,971 | E | * | 11/1998 | Kessler | 428/100 |
| 5,939,670 | A | * | 8/1999 | Shteynberg et al. | 174/49 |

FOREIGN PATENT DOCUMENTS

| | | | | |
|---|---|---|---|---|
| DE | 3205671 | * | 8/1983 | 52/288.1 |
| DE | 3842687 | * | 6/1990 | 52/717.01 |
| GB | 2239281 | * | 6/1991 | 52/717.01 |

* cited by examiner

*Primary Examiner*—Lanna Mai
*Assistant Examiner*—Phi Dieu Tran A
(74) *Attorney, Agent, or Firm*—Anthony Asquith & Co.

(57) ABSTRACT

For holding solid wood trim in place, around door/window frames. The trim has grooves in its undersurface. Corresponding splines are attached to the face of the wall around the frame. The splines enter the grooves, and the frictional force exerted by the tight fit is enough to hold the trim. At least one of the grooves/splines may be angled, so the trim becomes wedged tightly against the face of the wall and frame.

15 Claims, 13 Drawing Sheets

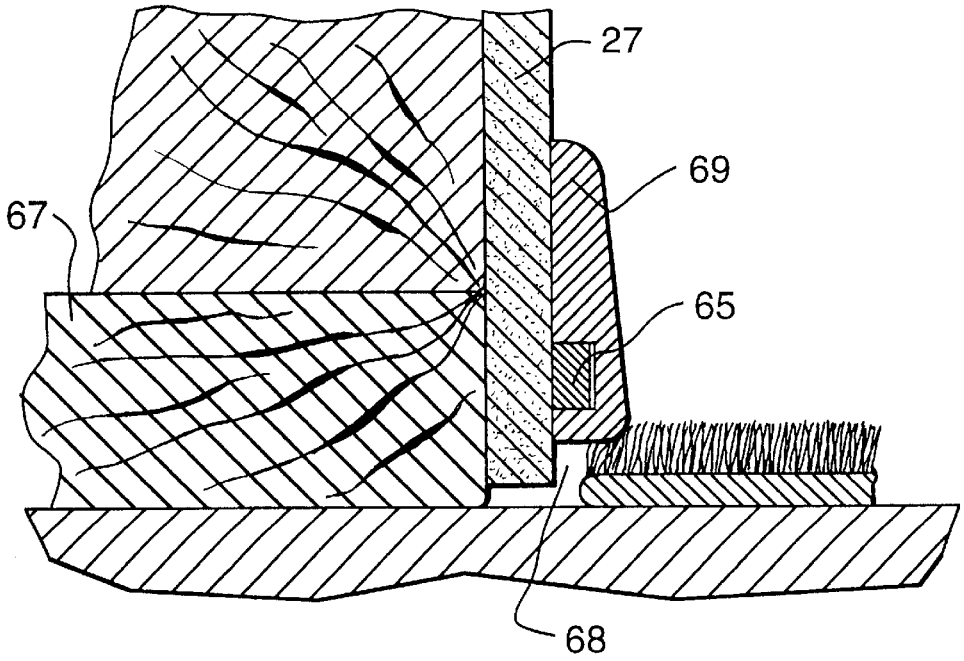
FIG.5
FIG.6.
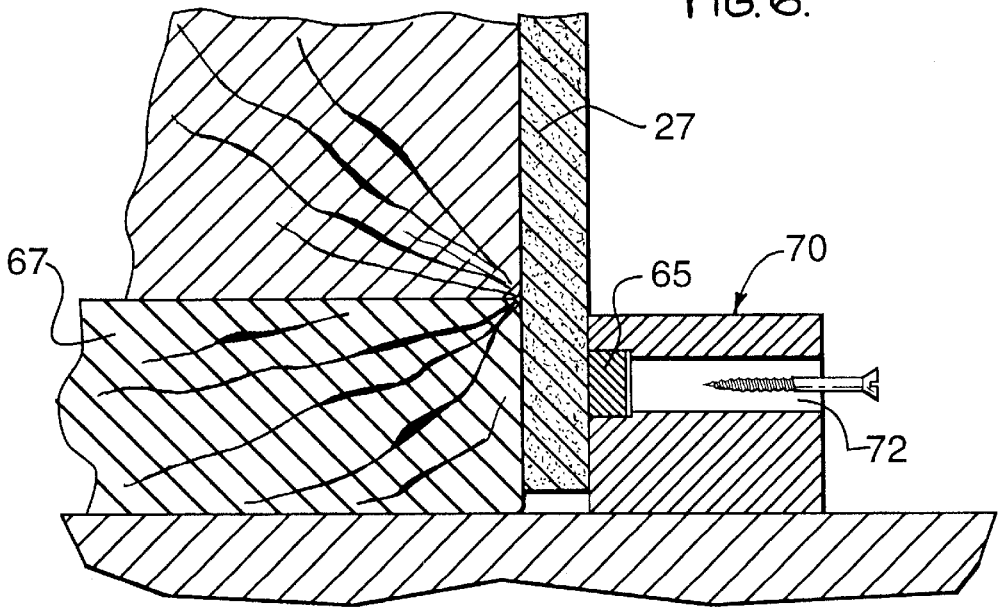

WOOD TRIM SYSTEM

This is a Continuation-in-Part of patent application Ser. No. 08/365,790, filed Sep. 21, 1994, now U.S. Pat. No. 6,148,885, which is a continuation-in-part of PCT/GB93/00583 filed Mar. 22, 1983.

This invention relates to wood trim, of the kind used to trim the edges of door frames and window frames, wainscotting, and also baseboards and skirting boards, in houses and other buildings.

BACKGROUND TO THE INVENTION

In the conventional manner of applying such trim, for instance around a door frame in a house, the carpenter cuts the lengths of trim, mitres the corners, and then nails the lengths of trim in place; then he drives the nail heads below the surface of the trim; he applies filler or stopper into the indentations; and leaves the filler to set. He returns later, and smooths down the filler. After that he applies stain, varnish, etc as required.

A good deal of care and attention is required of the carpenter when fitting conventional door trim. The door trim is very visible and noticeable, and if the job is done casually or carelessly the results can be most displeasing to the householder.

One problem with conventional trim is that finishing coatings cannot be applied to the trim until after the trim has been nailed up, and the nail-holes have been filled and smoothed. Especially when the trim is being applied to a new house the atmosphere is likely to be dusty, and dust can spoil the quality of the finish. Only a conscientious carpenter, working with a great care and attention, can be left with the job of applying and finishing the trim, especially if the trim is of the kind in which the decorative grain of the wood is to be displayed.

If the trim is to be painted, rather than left with the natural grain visible, the amount of attention needed to fill the nail holes, etc can be reduced. Consequently, it has been unusual for builders to provide wood trim in which the natural grain is left showing: the builder has far rather preferred to cover the trim over with paint, since the quality of craftsmanship needed to do that is rather lower.

The invention is aimed at providing a means for attaching wood-trim around a door frame, etc, which is far simpler for the carpenter than the above, and in which nothing (such as nail heads) mars the presentation-surface of the trim. It is an aim of the invention that the trim may be pre-finished, in-factory if desired, and applied to the wall in its finished form.

GENERAL FEATURES OF THE INVENTION

The invention provides a wood trim assembly, which is suitable for attaching solid wood door and window trim, wainscotting, baseboard trim, or the like to a wall. The assembly includes lengths of solid wood trim, and lengths of spline. Each length of wood trim is of constant cross-section along its length, as is each length of spline. The pieces of the trim are assemblable to the splines.

Each length of the solid wood trim includes a back face which is adapted to lie flat against the wall, and a decorative front surface. The shape of the cross-section of the solid wood trim includes a groove formed into the cross-section of the trim from the back face.

The spline is adapted to fit inside the groove in the trim, in that the cross-section of the groove is complementary in shape and size to the cross-sectional shape and size of the spline.

The spline is adapted to be fixed firmly to the wall, prior to the trim being assembled to the spline. The fit of the spline to the groove in the trim is such that, upon assembly of the trim to the spline, the spline being fixed firmly to the wall, the trim is assemblable over the spline by means of a manual (light) pounding action, whereby the trim, after assembly, remains firmly held in place by means of its frictional grip on the spline, and whereby the use of nails or glue to hold the trim is avoided.

The fact that the trim is held by a mechanical friction grip, and not by nails, nor glue, means that the trim is removable. This is an important feature of the invention, in that the trim can be taken off for such purposes as painting or papering the walls around a door frame, or for replacing a damaged piece of trim. Notwithstanding the fact that the trim is removable, the decorative surface of the trim is not subject to any compromise arising from the manner of attachment of the trim. The surface remains clear, whether the trim is removed and replaced often, or remains in place more or less permanently.

The fit of the groove to the spline, after assembly, across the width of the groove, preferably is between zero clearance and ¼ mm clearance.

Preferably, one of either the groove or the spline is tapered, to the extent that the clearance between the groove and the spline, upon presentation of the groove to the spline just prior to assembly is about ½ mm, on the basis that the groove is less than about 15 mm in width.

It is not intended that the wood trim should flex and snap over a bead of any kind, but rather that the tightness of the fit of the trim onto the spline arises because of the rigidity of the trim. For this reason, it is preferred that the cross-sectional shape of the trim, with the groove therein, is characterised as chunky and rigid.

The spline may be of wood or of plastic. If the latter, the cross-sectional shape of the spline may include resilient fingers which, upon assembly of the trim to the spline, engage, and press resiliently against, the sides of the groove.

The pieces of trim and the splines may be included as components of a kit, which also includes a jig for assisting in the accurate placing of the splines in the desired location on the wall.

The jig includes a spline holder, in which is formed a jig-groove, the jig-groove being complementary in cross-sectional size and shape to the spline. The jig is provided with through-holes, which are so positioned and arranged that screws can pass therethrough and through a spline positioned in the jig-groove, the through-holes in the jig being large enough that the heads of the screws can pass through the through-holes in the jig.

When the trim is being applied around the corners of a door frame, the jig includes two such spline holders, and the jig includes a brace for holding the two holders precisely set at right angles to each other. Preferably, the jig includes an abutment piece, which is so arranged as to provide an abutment for locating and positioning the jig flat against the jamb of a door frame.

Preferably, the abutment piece is no more than 2 mm thick, and is so located and arranged as to fit, in use of the jig, between the lintel of a door frame and the top of a door in the door frame.

When the jig is adapted for mounting wainscotting or baseboard trim, the groove is set a first distance from a first abutment surface on the jig, which is adapted to rest on the floor during use of the jig, and the groove is set a second distance from a second surface abutment which is adapted to rest on a carpet on the floor during use of the jig, the second distance being about 12 mm shorter than the first distance. This allows the jig to be used either on the bare floor, or with the room carpet in place.

Because the trim requires no nails etc to hold it in place, the trim can be pre-finished, ie the trim requires no painting etc after being assembled; therefore the ability to fit the trim accurately with the carpet in place, is highly convenient. (If the trim had to be finished, ie painted or varnished, after installation the prudent householder might wish to take up the carpet in any event.)

Optionally, the assembly includes a pair of the said grooves and a complementary pair of the said splines, the splines being linked by a web means, which is effective to hold the splines in a precise, spaced-apart, parallel side-by-side relationship.

Optionally also, the shape of the cross-section of the solid wood trim includes a cut-out which is suitable for receiving electrical wiring passing along the length of the trim, and the web is formed with an alignment means for aligning the wiring with respect to the web prior to assembly of the trim to the splines. This option is particularly advantageous when the two parallel splines are provided, because then it is simple to provide an alignment ledge or channel against which the wiring can be fixed, prior to assembly of the trim.

The fact that the trim is removable means that the addition of wiring later into a room can be accomplished very conveniently.

As mentioned, preferably the groove and the spline are plain-sided, in that the sides of the grooves and splines include no protrusions or beads or re-entrant aspects, and in that the fit of the trim to the spline is such that the wood of the trim is not required to flex resiliently, upon engagement. Wood might split if required to do that.

The invention also consists in a procedure for attaching solid wood door and window trim, wainscotting, baseboard trim, or the like, to a wall. The procedure includes the step of providing a length of solid wood trim, and lengths of spline; of providing a groove in the trim which is complementary in cross-sectional size and shape to the cross-section of the spline; of fixing the spline solidly to the wall by means of fasteners; of applying the trim over the spline, whereby the groove in the trim engages the spline; and of so dimensioning the groove and the spline that, upon engagement, the sides of the groove are in contact with the sides of the spline, thereby creating a frictional resistance to the dislodgement of the trim from the spline.

THE PRIOR ART

Of prior patent publications, DE-3,205,671 shows a trim attachment system where a spline engages a groove in a direction parallel to the wall. DE-3,842,687 shows a trim attachment system where a baseboard is arranged to stand-off from the wall. GB-2,239,281 shows a trim attachment system where a spline is a tight interference fit in a groove.

DETAILED DESCRIPTION OF PREFERRED EMBODIMENTS

By way of further explanation of the invention, an example of an embodiment of the invention will now be described with reference to the accompanying drawings in which:

FIG. 5 is a cross-sectional elevation of the foot of a wall, showing a baseboard attached thereto, which embodies the invention;

FIG. 6 is an elevation corresponding to FIG. 5, showing the use of a jig to assist in the positioning of the baseboard;

Figure 19A:
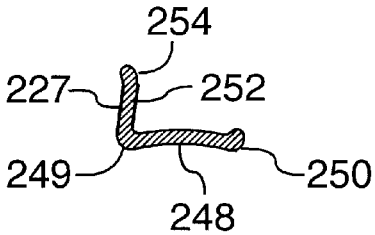
Figure 20A:
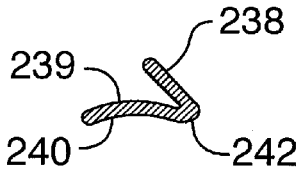
Figure 18:
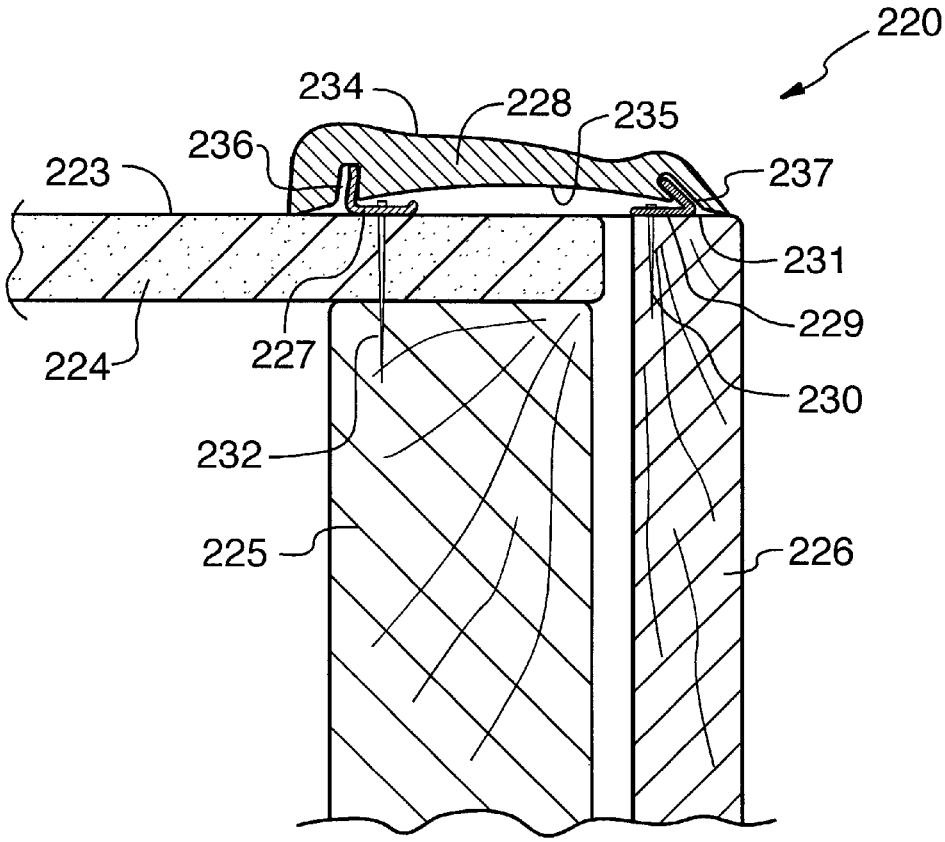
FIG. 18 is a cross-section of a wood trim installation which embodies a further aspect of the invention.
Figure 21:
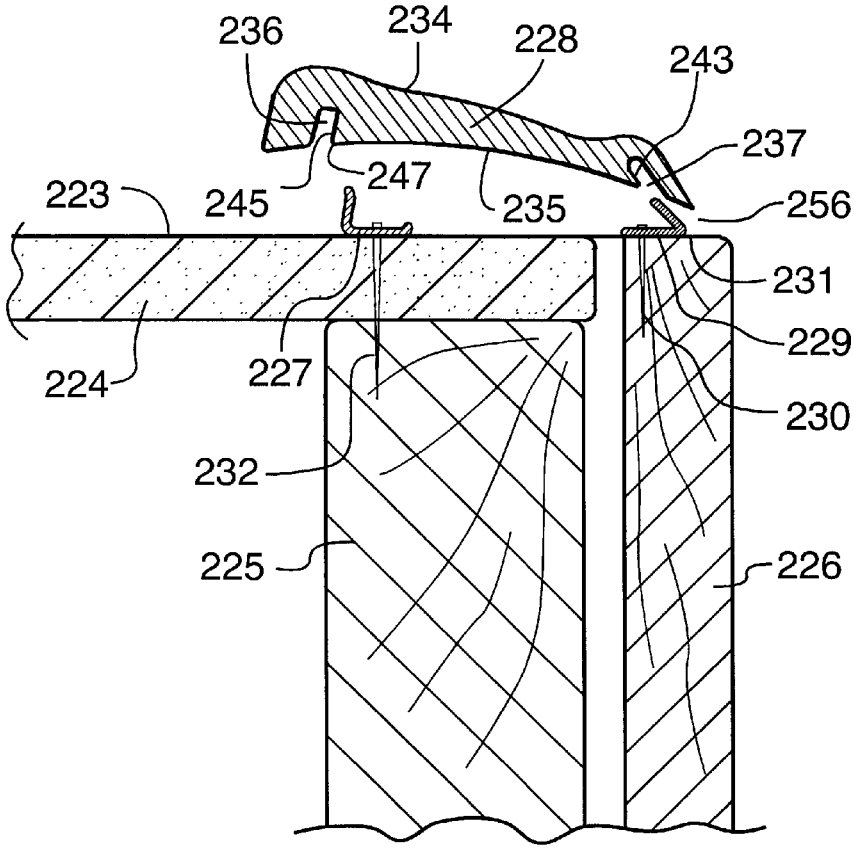
Figure 22:
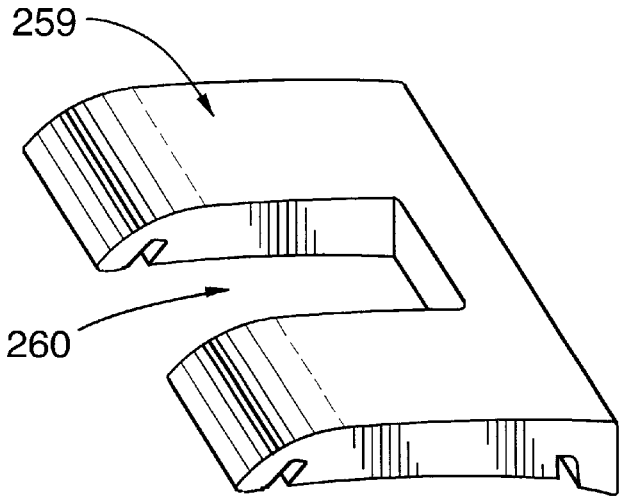
Figure 23:
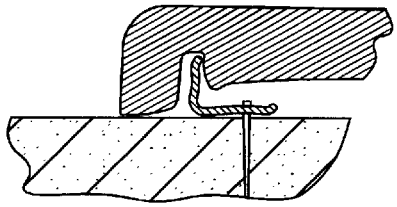
Figure 24:
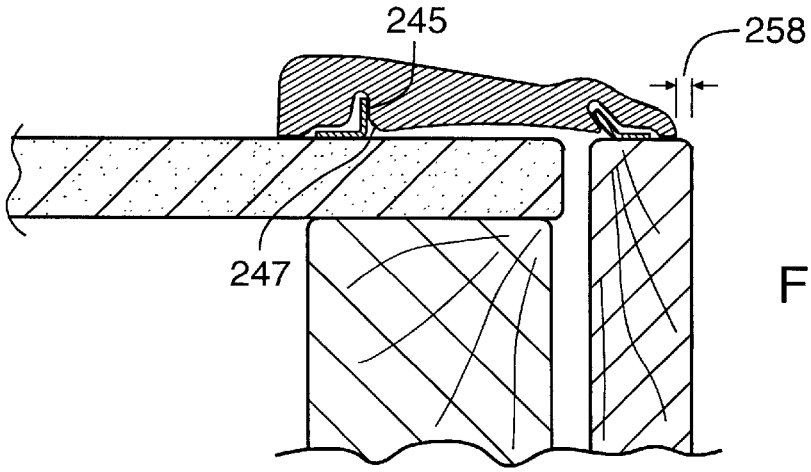
Figure 25:
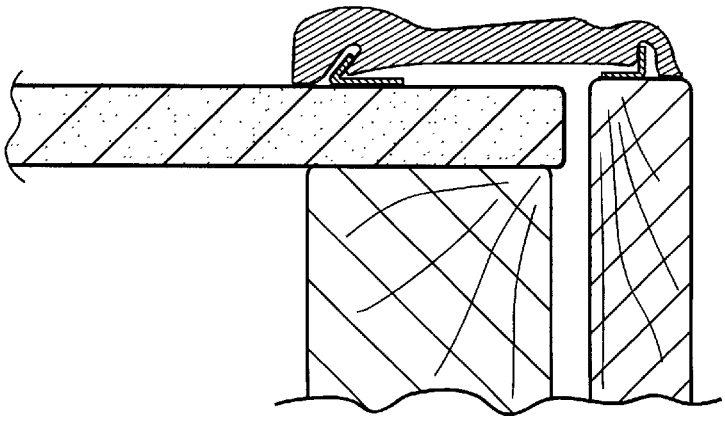

FIGS. 19*a,* 19*b* are cross-sections of a straight-spline of the installation of FIG. 18;

FIGS. 20*a,* 20*b* are cross-sections of a dovetail-spline of the installation of FIG. 18;

FIG. 21 is a view corresponding to FIG. 18, showing the components during the course of installation;

FIG. 22 shows a template, for use during the installation;

FIGS. 23, 24, 25 show alternative profiles for the splines of FIG. 18.

It should be noted that the scope of the invention is defined by the accompanying claims. The specific embodiments described and illustrated herein are merely examples of the invention, and the features of the examples are not necessarily the essential features of the invention.

Figure 1:
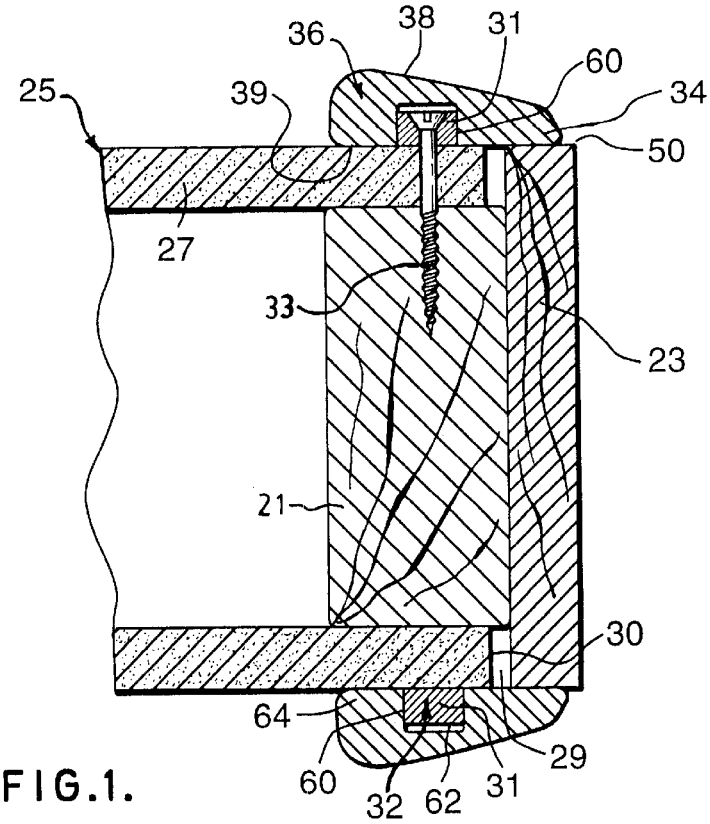
FIG. 1 is a cross-sectional plan view of an upright or side post of a door frame, which is trimmed by means of a wood trim assembly that embodies the invention.

FIG. 1 shows the upright or post of a conventional door frame 20, which includes a frame stud 21, and a jamb piece 23. The wall 25 of the room comprises wallboard or plasterboard 27 which is nailed or screwed to the stud 21 in the conventional manner. When the builder attached the plasterboard 27 to the stud, he left a gap 29 between the cut edge 30 of the plasterboard 27 and the jamb piece 23. Builders generally take no care to avoid leaving the gap 29, nor to cut the edge 30 neat and even, knowing the gap 29 will be covered by the trim.

In accordance with the invention, a length 31 of spline 32 is attached to the wall 25 around the door frame 20. The spline 32 comprises a rectangular strip of wood. The length 31 is attached to the wall 25 by means of screws 33 which pass through the plasterboard 27, and thread into the (wooden) stud 21 behind the plasterboard.

A length 34 of wooden finishing trim 36 is secured to the length 31 of spline 32. The wood of the trim 36 may be mahogany, for example, or oak, or other hard-wood that has a decorative grain, or a soft-wood such as pine or cedar, and the wood may be pre-finished with stain, varnish, paint, or other protective or decorative coating, as required. That is to say, the exposed face 38 of the trim, which will be exposed to view after installation of the trim, is pre-finished: it does not matter whether the unexposed back face 39 is pre-finished, since the back face 39 lies hidden, in contact with the wall 25, after installation. The invention is particularly suited to trim in which the grain of the wood will show through the finish, since these are the most difficult trims to install by other means.

Figure 3:
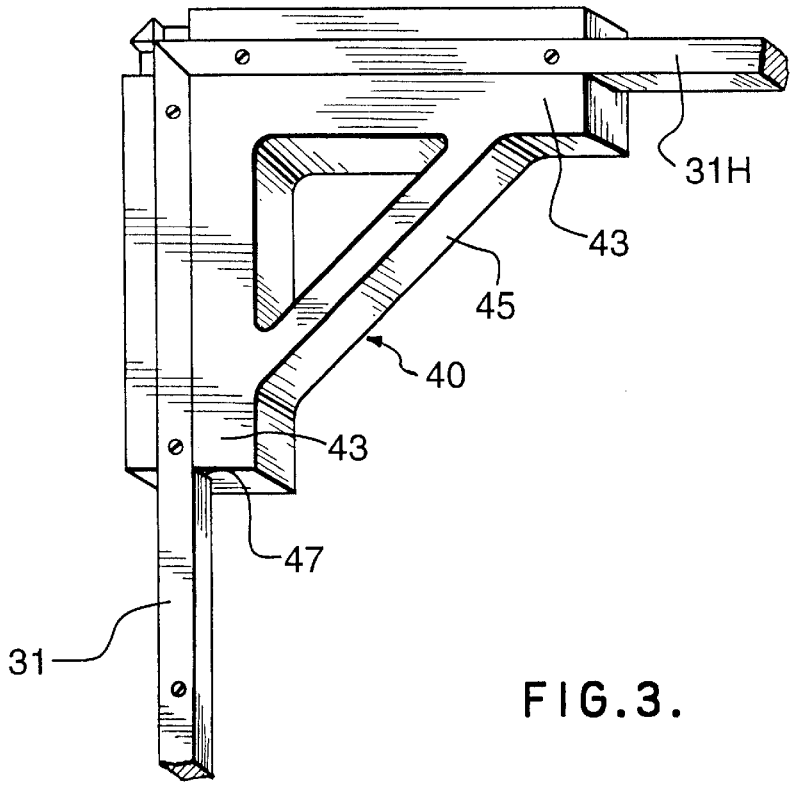
FIG. 3 is a pictorial view of a fitting jig, which is used to assist in correctly locating the components of the trim assembly of FIG. 1.

FIG. 3 shows a jig 40. The jig 40 comprises two spline holders 43 which lie at right angles to each other. The spline holders 43 are held rigidly precisely to the right angle by means of a triangulating brace 45.

The spline holders 43 are provided with jig grooves 47, for receiving the pieces 31 of spline 32 which are to be attached to the wall 25. The pieces 31 are pre-cut to length, and corner-mitred before being placed in the jig 40. The jig, with the two pieces 31 held in the jig grooves 47, is then presented to the door frame. FIG. 3 in fact shows the view of the jig and splines as seen from the door frame side.

An abutment piece 49 on one of the holders 43 allows the jig to be aligned straight with respect to the jamb piece 23. The corner 50 of the jamb piece (FIG. 4) tucks into the crook between the abutment piece and the holder 43. The carpenter slides the jig up the jamb piece 23 until the end 52 of the abutment piece 49 engages the undersurface 54 of the lintel 56 of the door frame 20. It is a very simple matter for the carpenter to place the jig in this position, and then to hold the jig in place.

The spline holders 43 are provided with holes 58. The holes 58 are large enough in diameter that the heads of the screws 33 can pass therethrough. Countersunk holes 59 in the spline pieces 31, for receiving the screws 33, may be prepared prior to the pieces being placed in the jig grooves 47, or the holes 59 may be drilled and prepared through the (large) holes 58.

With the jig and spline pieces in place, screws 33 are inserted through the holes 59, access to the screws being had through the clearance holes 58 in the jig. Once the screws have been tightened into the stud 21, and into the corresponding crosspiece 60 to which the lintel 56 is attached, the jig may be withdrawn, leaving the two pieces of spline screwed to the wall, the angle between the two pieces being exactly a right angle.

The angle between the jamb 23 and the lintel 56 will probably not quite be an accurate right angle, in a real house. It is one of the banes of applying trim that the carpenter may be perfectly accurate in mitring the trim pieces at exactly 45 degrees, but a slight out-of-squareness misalignment of the door frame makes it look as if an amateur had cut the mitres. The appearance of even a slight such mismatch of the mitred corners is quite obtrusively noticeable to the householder. It takes a good deal of skill on the part of the carpenter to avoid the appearance of mismatch of the mitres.

By the use of the jig 40, as described, the splines 31,31H in the corner of the door frame are always set precisely at a right angle, irrespective of whether the door frame is perfectly square. This means that, so long as the corresponding trim pieces are mitred accurately, the mitre will always appear neat and accurate, even if the door frame is (slightly) misaligned.

Figure 2:
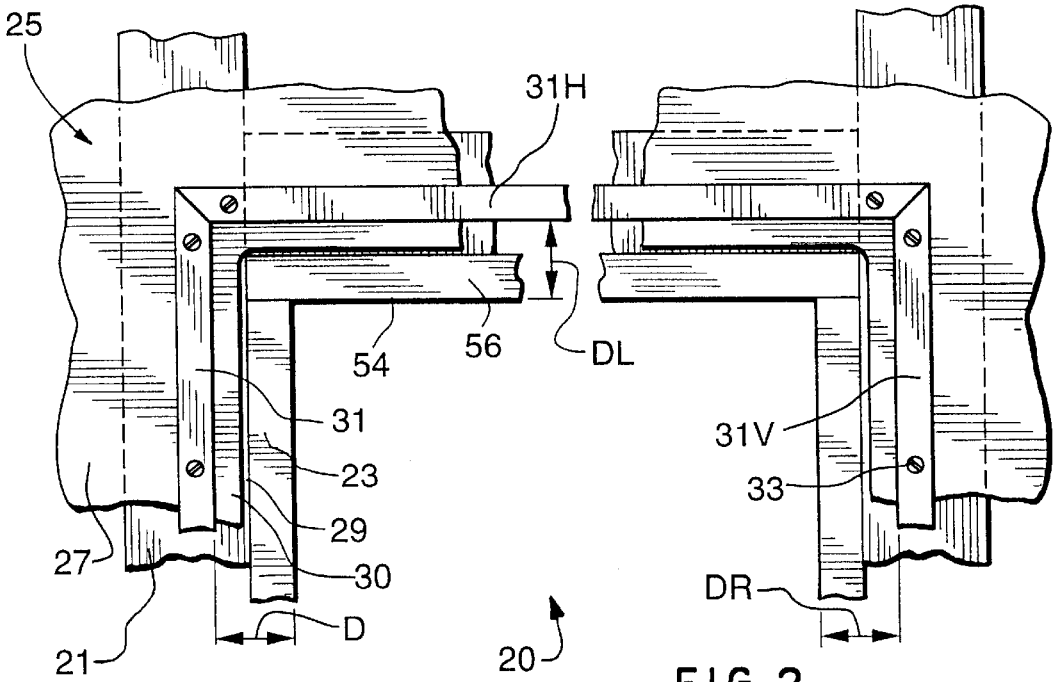
FIG. 2 is a front view of the door frame and trim assembly of FIG. 1, in which some of the components are removed.

The use of the jig also ensures that the spline is offset accurately a distance D (FIG. 2) from the corner 50 of the jamb, and a distance DH (which is equal to D) up from the surface 54 of the lintel 56.

When the jig 40 is removed, the vertical piece 31 of spline is left attached to the wall around the doorframe, but only the top two or three screws have actually been inserted (since the length of the spline holder 43 is only 40 or 50 cm. The lower portions of the piece 31 of spline at this point are not yet attached.

In addition to the angle between the jamb 23 and the lintel 56 not being quite square, it often happens that the jamb 23 is not quite straight, or is not quite vertical. The length 31 of spline protruding downwards therefore may not naturally align itself exactly the distance D in from the corner 50 of the jamb, all the way down the jamb, right to the bottom thereof. Similarly, the right hand end (FIG. 2) of the horizontal piece 31H of spline may not naturally lie a distance DL above the undersurface 54 of the lintel uniformly all the way along the lintel.

Therefore, the carpenter should use a ruler or the like to set the spline 31 a distance D accurately down the door frame, as he inserts the screws in that spline. Once the corner between pieces 31 and 31H has been set to a precise right angle, using the jig, and the splines secured at the corner with the first of the screws, the rest of the fixing of the piece 31 can be carried out easily and accurately.

The carpenter will usually have to bend the spline 31 slightly in order to make the spline conform to the accurate right angles and the "constant-D" requirements, if the door frame 20 is not quite perfectly straight and square. The spline itself is easily able to bend this small amount, but once the spline is screwed to the wall the rigidity of the wall is added to the spline, and the screwed-on spline therefore resists being bent any further (or straightened). Whatever slight curvature is built into the spline 31 as the screws 33 are inserted is therefore locked into the spline, with immense rigidity.

It follows therefore that the wood trim piece 34, when it in turn comes to be assembled to the spline, must conform to the same curvature, if any, that was built into the spline 31 in order to make the spline lie a uniform distance D from the door frame. The trim itself has a substantial rigidity in the plane in which the dimension D is measured: as the trim is forced to adopt a position of slight bending to conform to the misalignment of the door frame, quite heavy contact forces can arise between the trim and the spline, at the points where they touch. The friction arising at these points aids in preventing the trim from coming off the spline.

In fact, in order to assemble the trim 36, the groove 60 in the trim is first "started" over the spline 31 at one end, and then the trim has to be forced over the rest of the spline by a light pounding action, such as can be applied by a person striking the trim with the side of the closed fist. The force required to apply the trim onto the spline is reflected in the force it takes to remove the trim from the spline.

Of course, if the spline 31 were to be nominally too loose in the groove 60, the spline might be found to be still loose in the groove even after the spline has been bent to conform to the doorframe, especially when the door frame 20 is particularly straight and square. The nominal fit of the groove to the spline, and the tolerances on the fit, should be such that the groove has no more slack than about ¼ mm on the spline.

Thus, although at any one cross-section there may be a slight clearance between the groove 60 and the spline 31, nevertheless the trim has to be pounded onto the spline; and, having been pounded on, the trim is highly resistant to being dislodged therefrom.

The sides of the groove 60 can therefore be expected to be in firm, friction-generating contact with the sides of the spline 31, even though the groove is nominally clear on the spline. It should be noted that this aspect only applies to the width of the groove, ie the measurement parallel to the plane of the wall. The floor of the groove should be well clear of the corresponding front face 62 of the spline 31, in that the spline must not be allowed to "bottom" inside the groove.

It is found, in fact, that very few door frames are precisely square, to the extent that the spline 31 is never quite straight. Therefore, there is invariably some degree of misalignment between the spline and the trim, by means of which the trim is caused to grip the spline firmly. If the trim were too slack on the spline, of course the trim would fall off, and that should be avoided; it is not intended, in the invention, that the trim should be glued onto the spline. It is an aim of the invention to provide a trim that can be removed and replaced, for such purposes as painting or papering the walls of the room.

The task of removing trim for papering is very rarely undertaken with conventional trims, especially those in which the grain shows through. A decorator would have to take care not to damage or crack the wood during removal thereof, which is almost impossible trying to extract nails, and it would also be very difficult afterwards to mask the new nail heads, and to match any fresh finish that was applied to the trim. Room decoration is generally carried out with the trim remaining in place.

The system as described however makes it very simple to remove the trim for decorating purposes. A person can insert a blade or the like under a place on a piece of the trim where any slight consequent marring of the wood would not be noticed, and once started then the trim can be pulled progressively free of the spline. In doing this, even a careless person can undertake not to damage the trim in any way that would show. With the trim removed, the tasks of painting or papering the wall are very much simplified.

It is intended that the fit should be such that the trim can be easily applied to the spline by a light pounding action. With such a fit the trim cannot be removed by a direct pull, by a person using his fingers, but the trim can in fact easily be removed, as mentioned, by prying or levering the trim off the spline, starting at one end. A recess may be provided in each piece of trim to enable a pry bar to be inserted for removal purposes. Again, only minimal care is required to avoid damaging the exposed surface of the trim when using a pry bar in this manner. The recess should not be visible after the trim has been installed: a recess located on top of the horizontal piece 31H of trim would be unobtrusive enough; and once that piece has been removed the upper ends of the vertical pieces are exposed and can receive the pry bar.

In securing the horizontal piece 31H of trim, the following procedure may be followed. The left end (FIG. 2) of the piece 31H was screwed to the wall while the jig 40 was in place, leaving the right end, which has been already cut to size, and its extremity mitred, free.

Just as an important factor in fitting the first corner, as described, was to keep the two spline pieces 31,31H accurately at right angles, so that same factor is important in the opposite corner. Therefore, before screwing the right end of the piece 31H to the wall, the jig should be fitted over the right end of the piece; and the corresponding vertical piece 31V of spline that is to run down the right side of the door should be assembled into the jig. The carpenter should then take care to align the right corner as squarely as possible with the door frame.

Where the mitres in the trim and the spline are pre-cut to fit a door of a given nominal width, it will often happen that the actual door is a millimetre or so wider or narrower than the trim and the (accurately matching) spline. The result is that the dimension DR at the right side of the door may not be quite the same as the corresponding dimension D. This is not too critical, in that a (small) difference between D and DR would not be apparent to the householder except under close scrutiny: what should be avoided, however, is for the dimension DR not to be uniform over the whole height of the door frame. Thus, once DR has been set by the use of the jig at the top of the right side of the door frame, that same value of DR should be set (by measurement) all the way down the door frame.

This procedure is much easier to carry out than to describe, and in fact very little skill and craftsmanship is required of the person actually screwing on the splines in this manner.

Usually, installation of the splines will be carried out with the door itself not in place, for example when the builder of the house is using the system. The hinges too are removed, so that there is no difficulty of the presence of the hinges preventing the jig from lying flush against the wall around the frame. However, it is possible to arrange the jig to be usable without the door being removed, and in fact with the door closed. In this case, the abutment piece 49 has to be thin enough to fit into the crack between the top of the door and the lintel. A metal abutment piece, of 1 mm or so thickness may be used for this purpose. (If the door were so tight under the lintel that even so thin an abutment piece would not fit, then the door would have to be taken off.) Thus, the system as described may be used, with the jig, in an already existing house, on a retrofit basis, without taking the doors off.

Figure 4:
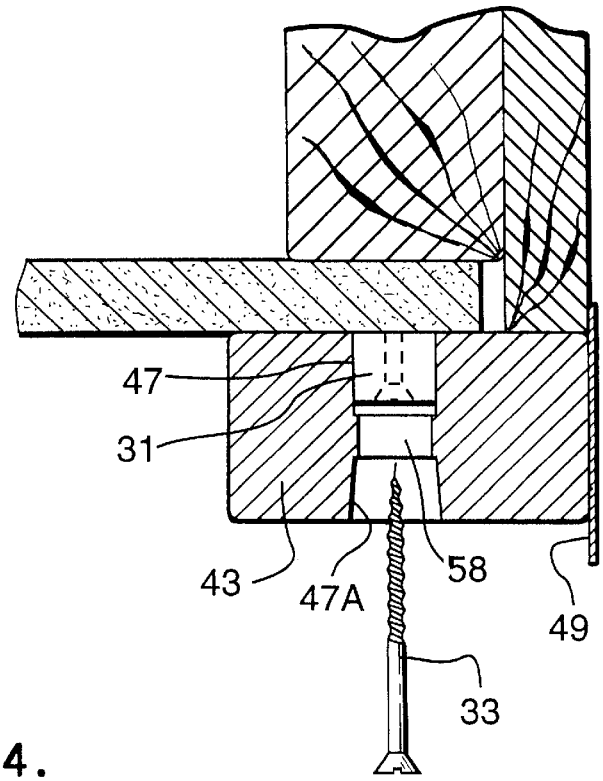
FIG. 4 is a cross-sectional plan view corresponding to FIG. 1, showing the jig of FIG. 3 in place on the door frame.

As shown in FIG. 4, the jig 40 is provided with spline-receiving grooves 47,47A on both sides. This allows the jig to be used either way round, ie on both corners on both sides of the door.

The cross-sectional shape 64 of the trim 36 is of a generally chunky character, with no slender or flimsy aspects. The cross-section 64 of the trim is, for the purposes of the invention, quite rigid. That is to say, the section 64 is not such as would permit the section to stretch over a bead or the like, and then snap into position. Solid wood, especially hardwood, like oak, cannot be made to do that, or at least not without an unacceptable risk of the wood splitting. On the other hand, it is this rigidity of the trim section which permits the section to resist being twisted into easy conformance with the inevitable slight misalignments of the spline, thereby creating the excellent grip as described.

A piece of trim when fitted to a spline as described is excellently secure, and is proof against any normal household knocks etc which might tend to dislodge the trim. The trim is after all in a fairly exposed location, ie around a door, and it would soon be found to be unacceptable if the trim were only lightly held in place, and had a tendency to fall off if subjected to household knocks.

Secure as the grip of the trim to the spline may be, however, the groove 60 is not a tight interference fit on the spline 32; if it were, the wood would have a tendency to split. The groove is nominally size-for-size with respect to the spline. The reason the trim grips the spline is not, as might be thought, because the cross-section of the spline is tight in the cross-section of the groove, or not primarily for that reason. Rather, the spline contacts the sides of the groove only at intervals. Because of the rigidity of the trim section, where contact does occur the contact force is heavy, which gives rise to the high friction with which the trim is held onto the spline.

One point that arises from the fact that the grip between the trim and the spline is so high is that the trim cannot readily be moved longitudinally along the spline. The carpenter must therefore take care to align the trim accurately in the longitudinal sense before pounding the trim into place.

If the mitred edges of the splines are placed close together, ie with no gap between the mitred edges, the line of the mitre can serve as an alignment marker to assist the carpenter to start the trim accurately in position. If the splines are positioned such that a gap is present between the mitred edges (as in FIG. 2) the splines cannot displace each other, but on the other hand the mitre line cannot serve as the alignment marker for the trim. It will usually be preferable to place the pieces of spline in the jig with the mitred edges actually touching: when screwed to the wall, any gap that might have opened between the edges during screwing would be minimal.

The sides of the groove (or the sides of the spline) may be provided with a slight taper or draft angle. The open mouth of the groove is then quite clear on the spline, which makes for easy assembly. As the spline enters the groove, the fit gets tighter. As mentioned, the fit never gets so tight that the wood has any tendency to split.

The taper is not very marked. When the trim is just being applied to the spline, the mouth of the groove is about ½ slack with respect to the top 62 of the spline. The taper is such that when the trim is assembled fully down over the spline, the groove is nominally size-on-size with respect to the spline. These dimensions apply to a spline that is 12 mm or so wide.

If the taper is put into the spline rather than into the groove, there might be a danger that the spline could be screwed to the wall wrong side out; this is a minor difficulty, however, because the correct orientation of the spline is indicated by the fact that the outside of the screw-holes in the spline are counter-sunk.

The groove 60 can be made very accurately, when made in a manufactory using precision groove-cutting machinery. Even if the groove has tapered sides, the required accuracy of the cut is within the everyday scope of factory equipment.

The spline 32 can be of wood or plastic. If plastic, it can be extruded accurately. If wood, again attention can be paid in-factory to getting the spline precise as to its dimensions, even if the taper is built into the spline. It may be noted again that not only is the cross-sectional shape 64 of the trim substantially solid and rigid, but the cross-sectional shape of the spline 32 also is substantially solid and rigid, as far as the cross-section itself is concerned. The grip of the trim to a wooden spline does not arise because of any resilience in the cross-sectional profile of either the trim or the spline.

An extruded plastic spline may, however, be provided with a profile having resilient fingers, which grip the inside of the groove with sufficient force to give rise to enough friction to hold the trim firmly on the spline.

FIG. 5 shows the application of the system of the invention to wainscotting, baseboards or skirting boards. Here, the spline piece 65 is screwed through the plasterboard to the sole plate 67 upon which the wall studs are secured. It is customary to leave a gap 68 underneath the baseboard 69 to enable the edge of a carpet to be fitted thereunder.

The spline 65 for the baseboard trim 69 is assembled correctly in place using a jig 70 (FIG. 6), which includes a single length of spline holder. As was the case with the jig 40, the jig 70 is provided with large through-holes 72, through which can pass the heads of the screws which secure the spline 65 to the wall. When the screws, and the spline, are in place the jig 70 is removed. The baseboard trim piece 69 can then be secured by lightly pounding it on, by hand, as was the case with the door trim. The baseboard trim is cut to the correct length prior to fitting, like the door trim.

The jig 70 has a length of about 80 cm. In using the jig, the carpenter starts at one end of the spline 65, locating the screws in position using the jig, and tightening those first screws into the wall. He then removes the jig from the end of the spline, and places the jig over the next portion of the length of the spline.

For ease of operation of the jig, it is preferred that the carpenter be able to slide the jig along the spline; therefore, the fit of the spline to the groove in the jig should have a little more slack than the fit of the spline to the groove in the trim. The fit of the spline to the trim is made tight enough that the trim, once pounded onto the spline, cannot slide along the spline.

If the screw-holes in the spline are pre-prepared, the holes 72 in the jig will have to be aligned with these screw-holes; some carpenters may prefer to make the screw holes through the holes 72 in the jig 70, to avoid having to view when the holes are aligned. It can be quite awkward to make the holes down at floor level, and of course if a drill is used to make the holes in the spline, some debris will be created. When it is preferred to pre-prepare the screw-holes in the spline, an alignment mark can then in fact easily be placed on the spline, to assist in aligning the through-holes in the jig with the screw holes on the spline. The arrangement of the jig as described permits the choice to be made between pre-preparing the holes in the spline, or making the holes in the spline when the spline is on the wall.

As shown in FIG. 6, the jig 70 rests on the floor, and it is this that determines the correct height of the spline 65, and hence of the baseboard trim 69. If the jig 70 is turned upside down, however, it will be inferred that the jig can be placed on top of the carpet, which then serves as the datum point to locate the height of the spline 65. Thus, the jig system may be used for the fitment of new baseboard trim without the need for taking up an existing carpet, and in fact by using the carpet as the datum to set the height of the baseboard trim. The distance from the groove to the face which rests on the floor is about 12 mm greater than the distance, with the jig upside down, from the groove to the face which rests on the carpet.

A further point that may be noted in regard to the splines used to attach baseboard trim is that the splines are available (when the trim is removed) for the attachment of plastic sheets and the like for covering the floor or carpet during decorating. Snap-on clips may be used to attach the plastic sheets to the spline. It is all too common, when protective sheets are laid on the carpet, for a gap to open between the sheet and the wall, and for the carpet to be soiled in that gap.

Figure 7:
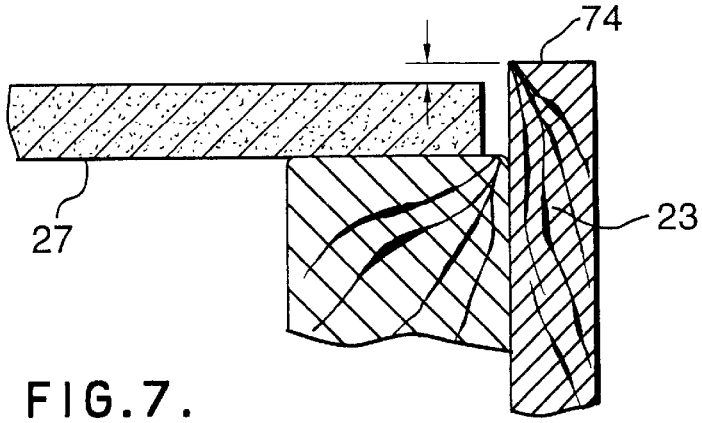
FIG. 7 is a plan view corresponding to FIG. 1, which illustrates a type of misalignment commonly encountered.

As shown in FIG. 7, it often happens that the edge 74 of the door jamb protrudes substantially with respect to the level or plane of the wall. In this case, the trim will not fit neatly flat against the wall as was shown in FIG. 1. What is worse is that the amount by which the edge of the jamb protrudes from the plane of the wall might vary over the height of the door frame. When that is the case, the trim is called upon to be twisted along its length, ie over the height of the door. The trim, being of wood and having a chunky cross-section is highly resistive of such twisting. This means that the grip of the trim to the spline has to be very secure, in order to lock the required (small) amount of twist into the wood.

Figure 8:
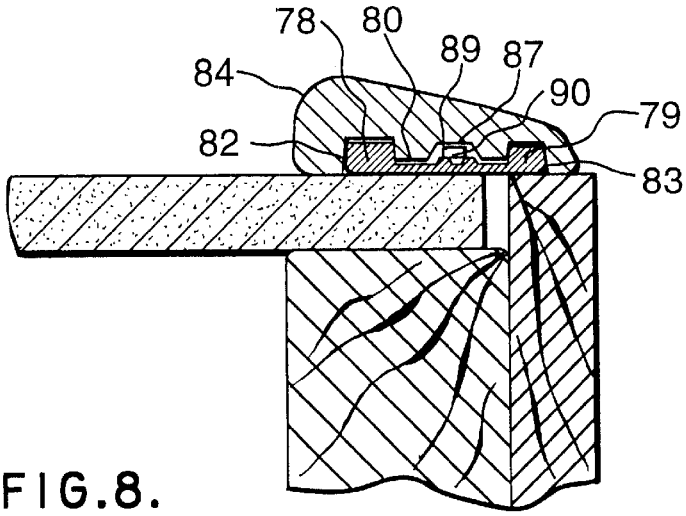
FIG. 8 is a plan view corresponding to FIG. 1, showing a further kind of wood trim assembly which embodies the invention.

This problem can be addressed by providing two splines, together with two corresponding grooves in the trim, as shown in FIG. 8. The two splines 78,79 preferably are joined together by means of a web 80. The web 80 serves to keep the two splines 78,79 at exactly the correct distance apart to enable them properly to engage and grip the grooves 82,83 in the trim 84.

It should be noted that the two grooves 82,83 each grip the two splines 78,79 on both sides, so that there is frictional contact along all four sides of the two splines. It may be considered that the two grooves and two splines arrangement of FIG. 8 is no different from a single, wide, spline and groove, as shown in FIG. 9.

Figure 9:
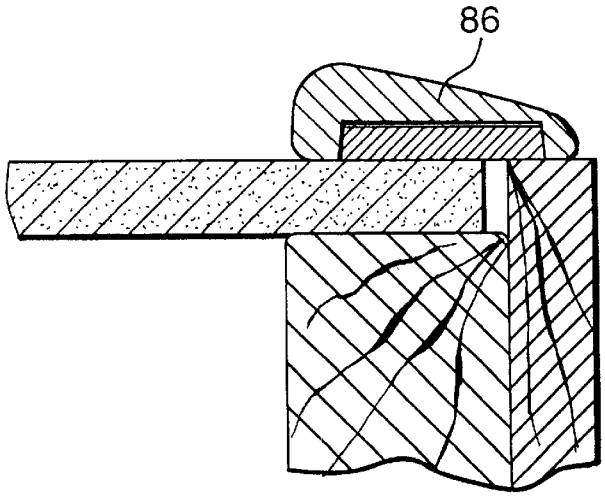
FIG. 9 is a plan view corresponding to FIG. 1, showing yet another kind of wood trim assembly which embodies the invention.

However, the use of a single wide spline 86, as in FIG. 9, is not preferred, firstly because the single spline gives rise to only two contact surfaces. A second reason for not preferring a single wide spline and groove is that wood changes its dimensions quite substantially depending on the amount of moisture in the atmosphere. The grooves and splines shown in FIGS. 1–8 are 12 mm wide, or less, which is small enough that any swellings in the wood are unlikely to have a measurable effect on such a small width. But if the groove and spline are say 30 mm wide, or more, as in FIG. 9, dimensional changes in the wood can start to have a significant effect on the fit of the trim to the spline. It would of course be unacceptable if the trim were to fall off the splines in humid weather. A preferred upper limit on the width of the groove and spline is about 15 mm.

When two grooves 82,83 and splines 78,79 are provided, as shown in FIG. 8, the dimensions of the grooves must be accommodated within the profile of the trim. It is usually the case that the trim slopes inwards towards the door, as shown, so that the groove 83 and spline 79 nearer the door would generally be made slightly smaller than the groove 82 and spline 78 nearer the outer edge. Of course, different profiles of trim have different requirements as to the dimensions of the splines that can be permitted.

If two splines and two grooves are to be provided, the spacing between the splines as the splines are screwed to the wall must be accurately maintained. The provision of the web 80 connecting the two splines is one manner by which accurate spacing between the splines can be achieved. Another way in which the required accurate spacing of two splines can be achieved is by the use of a jig which has two spaced-apart, parallel, spline-receiving grooves cut accurately therein.

In the case of two separate splines, each has to be attached independently. The screws for one spline (equivalent to spline 78 in FIG. 8) pass through the plasterboard and into the stud whereas it is usually more convenient for the screws for the other spline (equivalent to 79) to pass straight into the jamb piece.

In fact, when the two splines are connected by means of the web, it will often also be found advisable to insert screws through the spline directly into the jamb piece.

It sometimes happens that the householder wishes to run electrical wiring along the baseboards of a room, and around a door frame. This can be for the purpose of installing a telephone extension, for instance, or extra loudspeakers. There can also be a requirement to run mains wiring around doors and along baseboards, if such is permitted by local building codes. The system as described particularly lends itself to the easy fitment, and neat concealment, of such wiring. During manufacture of the wood trim, it would be of little consequence to provide, if necessary, a further groove or cut-away section 87 in the profile of the trim, to accommodate the wiring.

In the case of the double spline arrangement shown in FIG. 8, it is especially convenient to accommodate electrical wiring, because a portion 89 of the web 80 can be so shaped as to serve as a datum for aligning the wires 90 to correspond with the position of the wiring cut-out 87 in the trim profile. The wires are secured to the web prior to the trim being secured to the spline.

It is contemplated that the cross-section of the wood trim may be relieved on its back face, such that the trim touches the wall and the jamb piece right at the very edges of the trim. This helps to ensure that the trim fits neatly and without perceptible gaps against the wall surfaces. Although the cross-section is substantially rigid, as described, it is possible for such trim section to be able to "give", very slightly, when being pounded onto the splines, whereby the edges of the splines may engage the wall surfaces with some slight resilience. This slight resilience should however be contrasted with the (impossible) gross resilience that would be needed to allow solid wood to snap over a bead or the like.

The system as described enables trim to be fitted around a door or window, or as a baseboard or skirting board, without the use of nails. This is the case even though the trim is made of oak or other solid, rigid, wood which cannot be flexed or snapped over a bead or location key, or the like.

The fact that nails are not needed means that the trim can be pre-finished, eg in the manufactory where the trim is cut and prepared. The finish can now include very hard-wearing materials, of the kind that are only available if applied in-factory, such as finishes that are baked on, or applied under pressure, or dipped. When the finishing had to be applied after the trim had been nailed to the wall, the types of finishes were practically restricted to the types that could be painted on by hand, with a brush.

Figure 10:
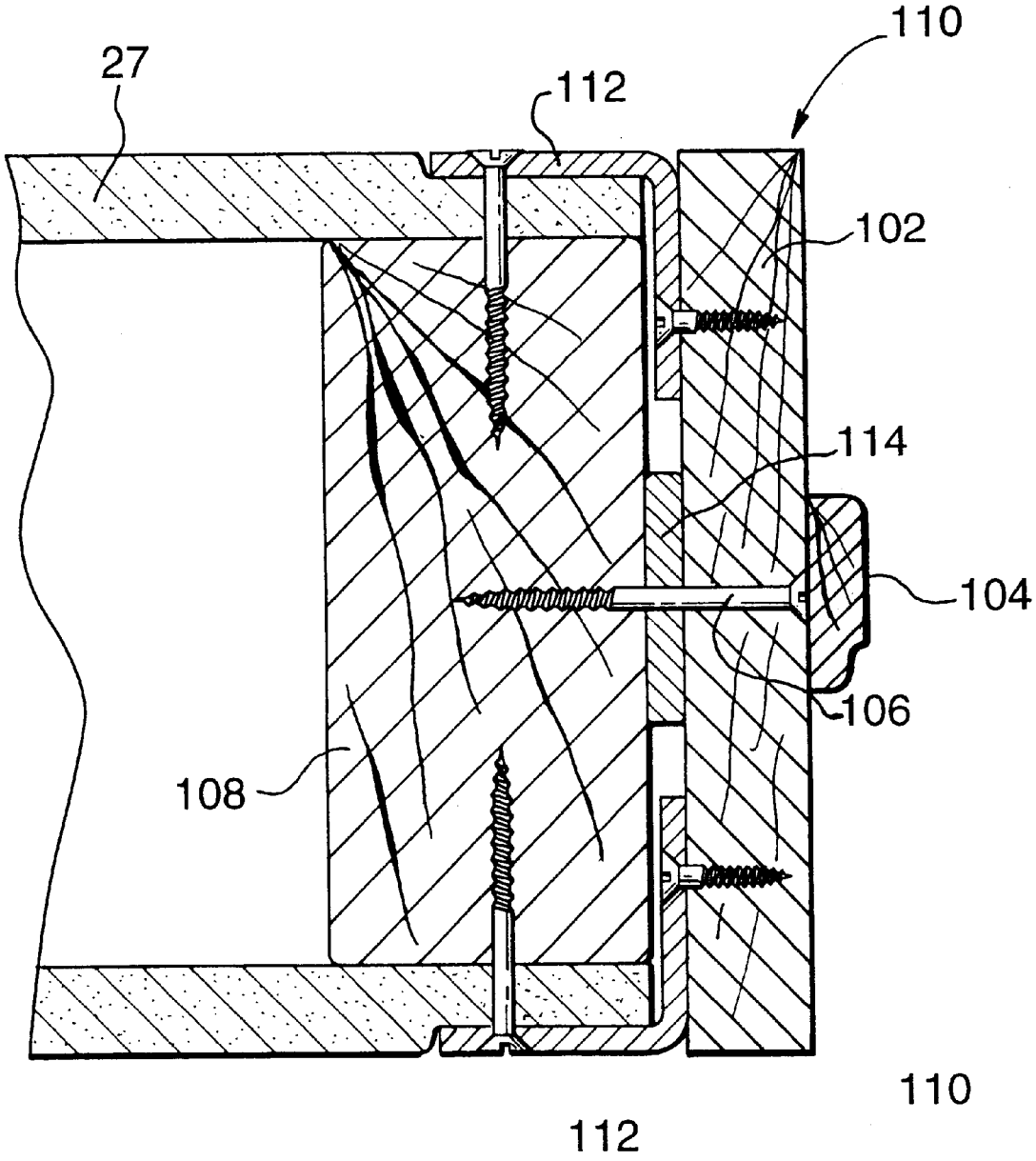
FIG. 10 is a plan view corresponding to FIG. 1, showing a modification to a door jamb, which is advantageous for use in the invention.

The kind of house-holder who seeks to fit solid-wood exposed-grain decorative trim around the doors etc is likely also to favour the use of exposed-grain solid wood not only for the trim but also for the door jambs. Again, one of the problems of using exposed-grain wood is that nail or screw heads must be confined only to those areas which are not open to view. As shown in FIG. 10, in a door jamb 102, most of the surface of the jamb is exposed to view, and therefore cannot receive nail or screw heads. The only zone of the jamb that is concealed is the zone that lies beneath the door stop-trim 104, and a screw 106 can be located underneath this trim, where the head will not show.

However, although the jamb 102 may be firmly held by the screws 106 that go through into the stud 108, the outlying edges 110 of the jamb 102 are somewhat unsupported, and the resulting lack of rigidity of the jamb can be a disadvantage. The situation is better with conventional trim, where some support is given to the outlying edges by the fact that the trim is nailed to the jamb and is nailed also to the wall. Similar support is also given to the outlying edges of the jamb when two splines are provided, as in FIG. 8. When only a single spline is provided, and when that single spline is attached to the wall, the trim that is pounded onto the spline offers little support to the outlying edges 110.

FIG. 10 shows how support can be provided for the outlying areas of the jamb, without resorting to exposed screw heads. In FIG. 10, metal angle-brackets 112 are screwed to the back of the jamb 102, before the jamb is applied to the stud 108. The dimensions of the stud, jamb, etc are such that the outer faces of the angle-brackets 112 lie flush with the outer surfaces of the plasterboard panels 27. When the jamb, with the brackets 112 attached, is applied to the stud 108, the edges of the brackets tear the material of the plasterboard panels in reaching the position as shown in FIG. 10. Of course, the plasterboard material is easily able to be torn and dented locally in this manner, and the torn and dented area will be covered up by the trim.

Often, the stud 108 is not straight and true, and it is a matter of common practice for shims 114 of appropriate thickness to be placed between the jamb 102 and the stud 108. In a case where the stud is badly sloping, for example, the jamb might need to be shimmed out, say, 1 cm from the stud at the top, but may lie against the stud at the bottom. The designer should ensure that the position of the screw holes in the brackets 112 allows for such position adjustment between the jamb and the stud.

In fact, it has been found that the shims 114 can be omitted. If the brackets 112 are strategically located close to the door hinges and latch areas, it has been found that even just a small number of the brackets is sufficient to mount the jambs very solidly indeed, and that screwing the jamb 102 directly to the stud 108, through the shims 114, is not necessary. This is a useful saving because the task of measuring and providing shims of the correct thickness was quite labour-intensive.

The trim, of course, when applied, will cover the brackets. It is important to note that the trim is not nailed to the jamb and therefore the trim cannot aid in supporting the jamb, but this is not a disadvantage because the jamb can be easily and quickly mounted to the stud very solidly using the brackets 112.

With the angle-bracket system as shown in FIG. 10, the trim can be attached by means of the single spline, as described, and yet the jamb is supported from the stud with no less solidity (in fact with more solidity) than when the trim was nailed to both the jamb and the wall.

Figure 11:
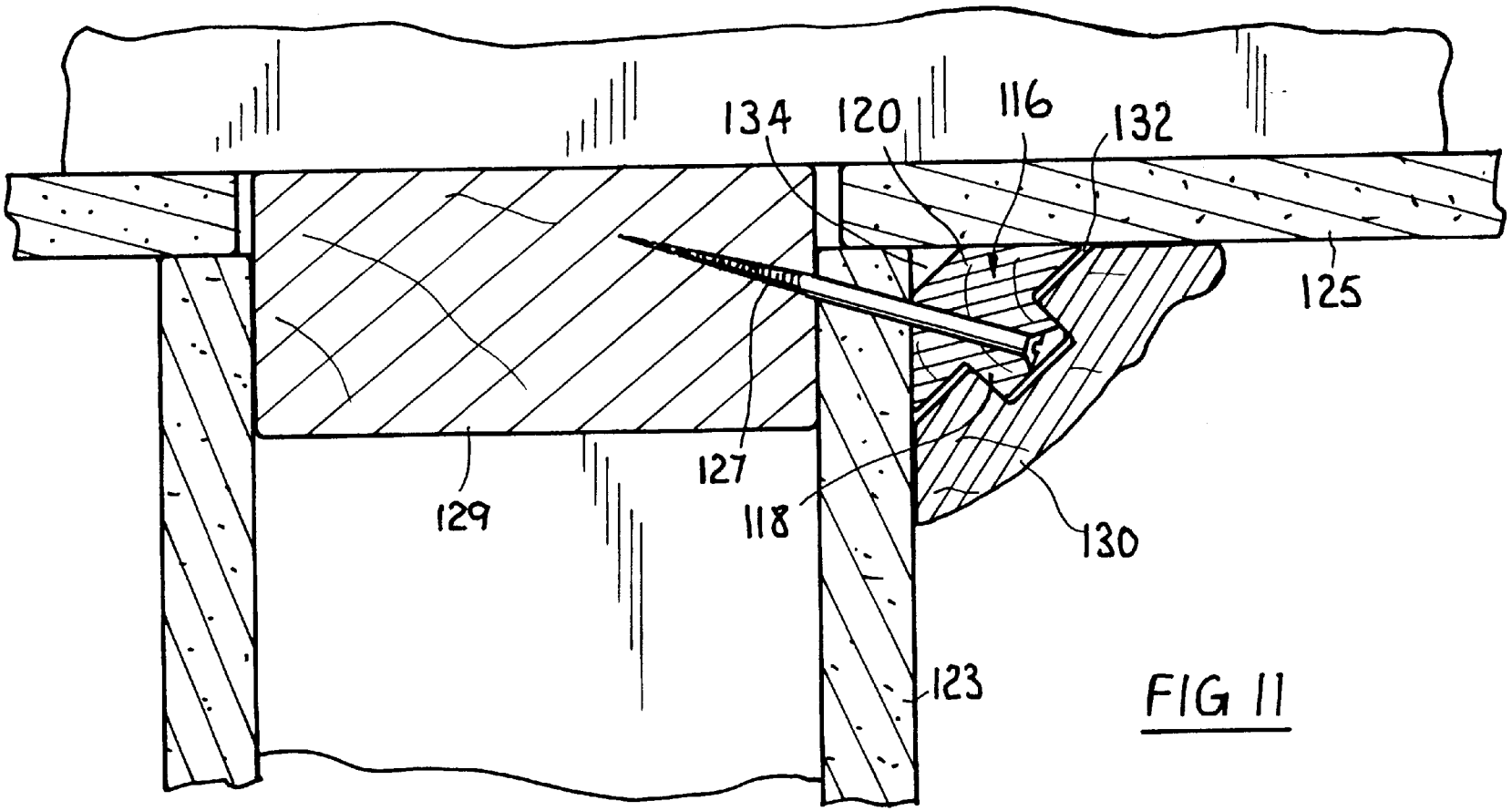
FIG. 11 is a cross-sectional elevation of the top of a wall, showing a corner moulding attached thereto, which embodies the invention.

The trim attachment system, as described, can be used to attach trim to door frames and window frames, and can be used also to attach baseboards or skirting boards. The trim attachment system can also, with a little modification, be used to attach the type of trim used for crown- or corner-mouldings to the corner between the wall and ceiling of a room. FIG. 11 shows a manner in which this may be done.

In FIG. 11, a specially shaped spline piece 116 includes a spline 118 and a body 120. The body 120 is so shaped as to fit into the corner between the plasterboard wall 123 and the plasterboard ceiling 125. Only when the body 120 is in the correct orientation with respect to the corner does the piece 116 fit correctly. A hole for a screw 127 is provided in the piece 116, and the hole is angled so that the screw lies at the angle shown, whereby the screw 127 can be driven into the wooden top plate 129. By tightening the screw at the angle shown, the piece 116 is drawn into the crook of the corner.

The moulding or trim 130 is cut accurately to correspond to the spline 118, whereby, when the trim is applied to the piece 116, the trim lies accurately, without gaps, against the wall and against the ceiling. It will be understood that if the wall and ceiling are slightly curved or otherwise misaligned (as they usually are) the piece 116 will follow the misalignment, and will force the trim also to follow the misalignment, whereby the trim can be expected to fit perfectly all along the length of the corner, ie all around the room. As was the case with the door frame, even though the trim is itself very rigid, the spline takes on the immense rigidity of the wall, and forces the trim to conform to the wall. Of course, the degree of misalignment here discussed is the small degree that is nearly always present in a room that nevertheless looks generally straight and square; the invention is not able to address gross misalignment.

It is these small misalignments that hitherto have troubled carpenters with problems such as the uneven gaps that can occur when working with rigid materials like solid wood trim. Rigid though solid wood trim is, the spline, upon being attached to the wall, is even more rigid, and therefore can force the trim to conform to the wall.

The spline 118 may be separate from the body 120 of the piece 116, but then the accuracy of the location of the spline might be in doubt. Preferably, the piece 116 is unitary; the piece may be a plastic extrusion for example.

As shown in FIG. 11, it is important that the trim 130 should bottom not against the piece 116 but against the wall and ceiling, and the gaps 132 as shown ensure this. It is also important that the piece 116 should not bottom itself into the crook between the wall and the ceiling, since that crook often contains irregularities. The corner of the piece 116 is relieved, at 134 as shown, to ensure this.

It has been stated as a general rule that the splines should be attached to the wall by means of screws. It will be understood that other types of fasteners, such as nails, can be substituted in appropriate cases.

Figure 12:
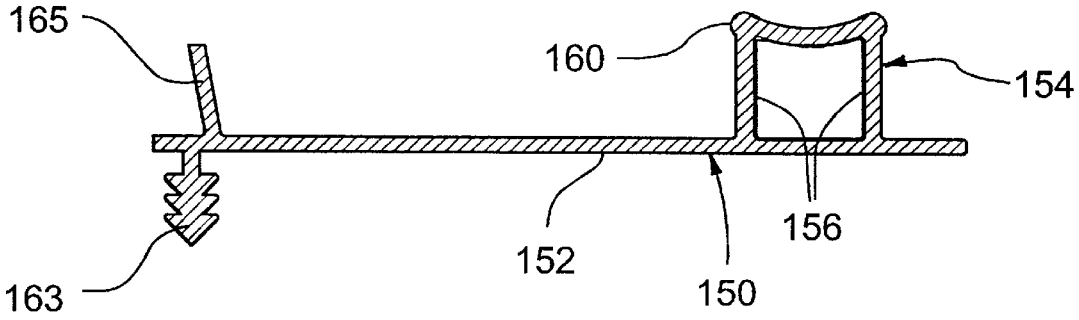
FIG. 12 is a cross-section of a spline-strip, for use in the invention.
Figure 13:
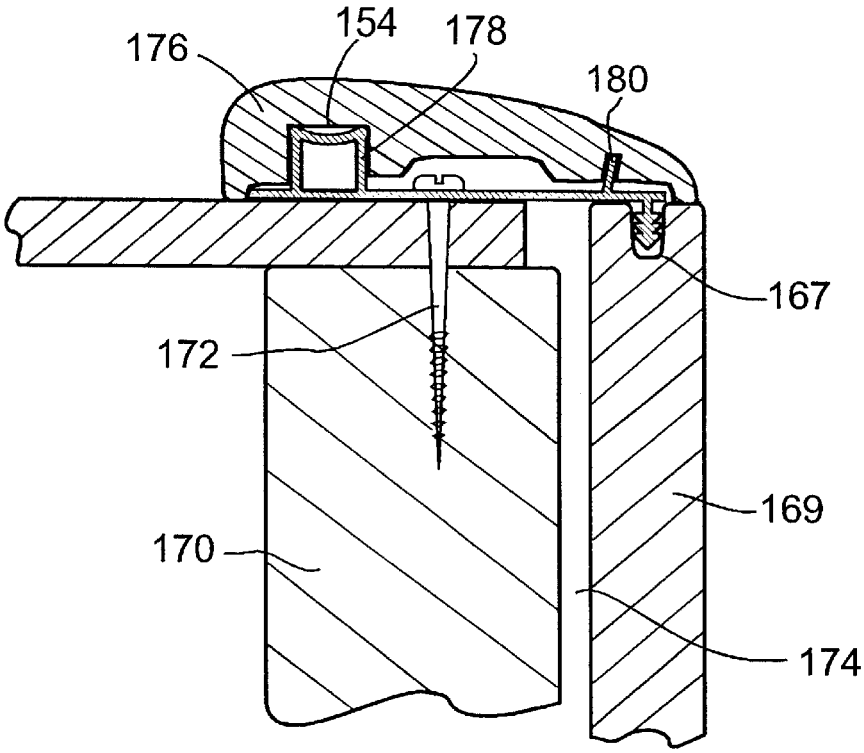
FIG. 13 shows the strip of FIG. 12 in an installation.

FIG. 12 shows a trim attachment strip 150, which is formed as a plastic extrusion. FIG. 13 shows the strip of FIG. 12 in use to attach a piece of wood trim to a wall, associated with a door opening.

The profile of the strip 150 includes a base or web 152, which lies flat against the wall. (The web may be bowed slightly, in profile, so that when the strip is nailed flat to the wall the edges of the profile are pressed against the wall.) Protruding outwards from the web 152 is a spline 154. The spline 154 has the form of a hollow rectangular box, comprising left and right side walls 156 and a roof 158.

The roof 158 is slightly curved, as shown. At the outer corners of the junction between walls and the roof, the profile includes a small, radiused promontory 160. By virtue of the promontories 160, the spline 154 is slightly thicker at its outer end, or roof end.

Protruding inwards (with respect to the wall) from the back of the spline-strip 150 is a protrusion 163. This protrusion is ridged, as shown in FIG. 12.

Protruding outwards from the front of the spline-strip 150 is an inclined rib 165. The rib 165 protrudes not at right angles, but at the slight angular inclination as shown in FIG. 12.

FIG. 13 shows the spline-strip 150 installed. The ridged protrusion 163 engages a groove 167 cut in and along the length of the edge of the (wood) door-jamb-piece 169. By this engagement, the spline-strip 150 and the jamb-piece 169 are locked together against relative lateral movement.

As shown in FIG. 13, the door-jamb-piece 169 is secured in place relative to the door opening by virtue of the fact that the spline-strip 150 is secured to the wall stud 170 by means of screws 172. (Nails, staples, etc, may be used to secure the spline-strip.) The exact position and orientation of the jamb-piece 169 in the opening can be adjusted by adjusting the exact place in which the spline-strip is fixed to the stud.

The jamb-piece as illustrated in FIG. 13 is located at the door-hinge-side of the opening, and it will be understood that the corresponding jamb-piece at the door-open-side of the opening is secured in a similar manner. Also, the jamb-piece of the lintel of the opening is secured in similar manner.

The spline-strip 150, arranged and used as described, provides for a very simple installation of the door-jamb-pieces and the lengths of trim around the door, even though the installer may not be a skilled craftsman. The arrangement as described enables the installation to be done in a manner that make it easy to ensure that the mitred corners of the finishing wood trim will be exactly square and even.

Usually, a door opening is not exactly square and even. The installer may temporarily secure the lintel jamb-piece and spline-strip, and then, with the aid of a set square or jig, align the hinge-side and the open side-jamb pieces and spline-strips. He may install both the inside-the-room and the outside-the-room strips at the same time. Generally, the installer will find that he can easily set the lintel piece first, and then can set the two side pieces exactly at right angles to the lintel piece.

In FIG. 13, it will be noted that no shims are required between jamb-piece and stud in order to hold the jamb-pieces in their correct location in the opening. The jamb-pieces are fully located and constrained by the spline-strips, and by the screws 172. The space 174 is made large enough to accommodate such out of squareness and other unevenness as may be required, to ensure that the jamb-pieces and the spline-strips can be put in place exactly at right angles to each other.

The jamb-pieces 169, spline-strips 150, and the lengths of trim 176, may be pre-made in-factory. The purchaser states the size of the door, and is supplied with the appropriately-sized kit; all the items in the kit are pre-cut to size and all mitres are pre-cut on accurate factory machinery. A kit may be made up of pre-cut and pre-mitred spline-strips; also, pre-cut and pre-mitred lengths of trim (which are not only pre-cut and pre-mitred, but are also fully and finally finished); and also, fully and finally finished jamb-pieces. Since doors come in a limited number of standard sizes, it is economical for wood trim shops to hold stocks of the pre-cut trim, spline-strip, and jamb-pieces in kits for the various standard sizes of door.

The pre-made trim kits provide even the amateur carpenter with a simple way of ensuring that all mitres are not only cut perfectly, but are installed at an accurate right angle. This is in addition to the already-described benefits of the system of the invention: (a) the fact that no nails etc are used to secure the trim means that the trim may be made with a factory-applied finish; and (b) the trim is removable and can be removed and replaced to simplify the task of wall-papering, painting, etc.

In some cases, the installer might wish to remove a sliver of material from the edge of a jamb-piece 169, for example to make the edge lie flush with the wall surface. The grooves 167 should be made deep enough to allow for some material to be removed from the jamb-piece, and still leave the groove deep enough that the ridged protrusion 163 does not bottom in the groove.

The profile of the wood trim 176 may be provided with a space to receive electrical wires running inside the trim. Such wires may be held in place with special clips, which hook into holes drilled in the web of the spline-strip.

The trim 176 is provided with a spline-groove 178 and a rib-groove 180. To install the trim to the spline-strip 150, the length of trim is first assembled over the leaning rib 165; the rib 165 bends slightly when the trim is pressed down over the spline 154, resulting in a (slightly) heavier contact force between the rib 165 and the trim 176, and a force which tends to draw the edge of the trim into a slightly tighter contact with the jamb-piece.

The spline-groove 178 and the spline 154 have a slight interference fit, especially over the roof-end of the spline, where, as mentioned, the spline is slightly thicker because of the corner promontories 160. The roof 158 is able to bend (in a buckling mode), to the extent required for the spline 154 to fit in the groove 178 with a good contact force.

The hollow-box form of the spline 154 profile is excellent in providing just the right degree of stiffness and resilience in the spline.

It may be noted that if the spline were solid, only a very limited degree of interference between the spline and the spline-groove could then be allowed—typically about 0.01 mm maximum. The designer dare not provide more interference than that, or the spline-groove 178 in the trim may tend to crack open.

The solid-spline system as described with reference to FIGS. 1–11 is able to provide excellent retaining and holding power of the trim to the spline, even though the spline has only a light interference, hardly any interference, or no interference at all, with the spline-groove. However, when the spline is made of plastic, in the form of an extrusion in PVC, for example, the coefficient of friction between the PVC of the spline and the wood of the spline-groove can be low enough that the designer wishes to resort to interference to provide the holding power needed.

Heavy interference cannot be contemplated when the spline is solid. A solid spline has too little resilience, and if the interference is just slightly too much, the wood trim will crack. On the other hand, if the "spline" were to take the form of two protruding arms, side by side, and cantilevered out from the web, the resilience of the arms would then be too much: it would not be possible to develop enough contact force between such arms and the sides of the spline-groove to give enough holding power.

It may be regarded that in the hollow-box profile of the spline the roof 158 serves to hold the outer ends of the left and right walls 156 apart. The roof 158 is resilient enough, in the bending/buckling mode, to allow the walls to bend inwards slightly, if the groove should be cut narrow, and yet enough interference is provided to ensure good holding power if the groove should be cut on the wide end of its permitted tolerance range. This just-right degree or rate of resilience of the spline is enhanced if the roof 158 is given the preliminary curvature, as shown.

The thickness of the roof can be adjusted, also, to provide just the right degree of resilience: it has been found that making the roof slightly thinner than the walls can help give the right balance between a too-hard spline, which has no give, and splits the wood trim if the groove is slightly too tight, and a too-soft spline, in which the spline does not provide enough grip to the sides of the groove. The hollow-box design of spline enables the spline to grip the trim tightly enough for good securement, over a tolerated range of groove widths.

The degree of resilience attributable to the hollow-box profile of the (plastic) spline may be expected to provide holding power over a tolerance range of the order of 0.02 mm.

The hollow-box profile allows more interference between spline and spline-groove than was the case with the solid spline. In the context of plastic splines: on the one hand, a solid plastic spline has hardly enough resilience to permit any interference; on the other hand, two cantilevered arms would have too much resilience. But two cantilevered arms joined by a roof (which is what the hollow-box profile amounts to) has just the right degree of resilience to provide a good holding force without demanding difficult-to-manufacture tolerances. Interference-fits generally require tight tolerances: the hollow-box profile for the plastic spline eases that requirement enough that a factory-cut groove in a length of solid oak or other wood trim can be accurate enough.

A problem that can sometimes arise with mitred corners is that the wall is not quite flat in the plane of the wall. As a result, at a mitred corner, the horizontal lintel trim might protrude perhaps a half-millimetre further out from the wall than the vertical trim. Even though the mitre might be exactly a right angle, such protrusion-mismatch can be quite noticeable.

Figure 14:
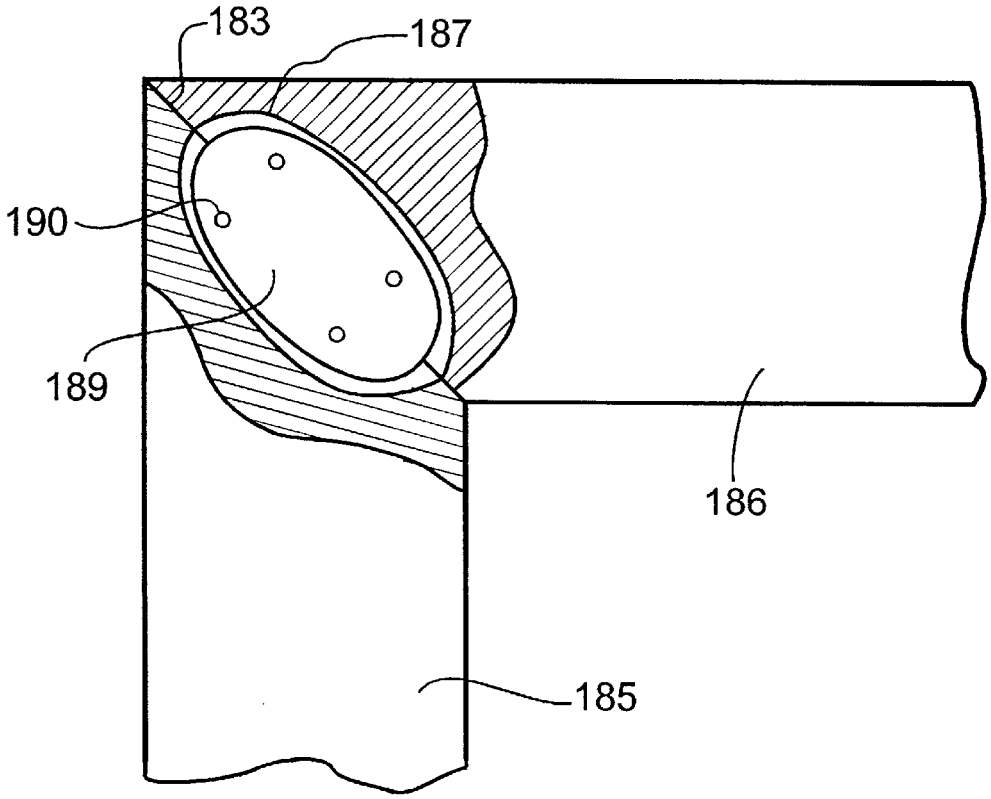
FIG. 14 shows a mitred corner between two lengths of trim.

FIG. 14 shows how the lengths of trim may be joined together at the mitred corners, in a way that eliminates protrusion-mismatch. The mitred edge 183 of the vertical length of trim 185, and the corresponding mitred edge of the horizontal length of trim 186, are provided with slots 187, into which is inserted a biscuit 189. The biscuit 189 is a piece of hardwood or plastic sheet formed to the oval shape as shown. The biscuits may be glued in place, or, if the trim profile is of appropriate thickness, the biscuits may be screwed in place, as at 190. Of course, the screws are screwed in from the back of the trim, and must be short enough not to extend right through the trim.

The trim lengths 185,186 are secured together before being placed on the wall. This means that the installer must be able to rely on the accuracy of the mitres, as cut, in both the trim lengths and the spline-strips. It will be understood that securing the trim-lengths together with biscuits, and then placing the secured-together trim-lengths on the spline-strips, poses a very demanding requirement for accuracy of the mitres and of the dimensions of the pieces. However, such accuracy is available if the mitred joints between the trim lengths and the spline strips are factory-made to suit the particular door size. The pre-grooved door-jamb-pieces 169 should be included also in the same kit.

It is recognised that the in-factory-accuracy of making the mitred joints in this way is not wasted nor compromised, even if the door opening is (as they usually are) not truly accurate and square.

It is convenient to join the lintel trim-length to the two vertical trim-lengths, by means of the biscuit connectors, just before the sub-assembly comprising the three trim-lengths is applied to the already-installed spline-strips. The sub-assembly of the three trim-lengths is awkward, and vulnerable to transit damage; however, a professional trim installer may be willing to take the trouble to handle the vulnerable assembly with the needed care, in exchange for the benefits of pre-making and pre-gluing the biscuit connectors in-factory.

Pre-making the sub-assembly of the trim-lengths by pre-gluing biscuit connectors into the joints is much more efficacious in the case of window trim. With window trim, there are four lengths of trim, in the form of an enclosed rectangle. A window trim sub-assembly, being an enclosed rectangle, is much more robust than a door trim sub-assembly, and can be expected to survive handling by amateur craftsmen. However, it will be appreciated that the need for accurate cutting of the lengths and of the mitre angles is very pressing when the trim is installed as a sub-assembly onto the already-installed spline-strips; such pre-making of the sub-assembly is only possible when the pieces are supplied together, in a kit, having been made on accurate machinery.

In fact, if there is protrusion-mismatch of the trim-lengths at a mitred joint because the wall surface is not quite flat, the two spline-strips making up the joint also may be expected to have the mismatch. Indeed, in some cases, if the mismatch of the spline-strips is eliminated, there will be no need to cater for mismatch in the trim itself. Certainly, the installation and attachment of the trim lengths (and the possible detachment if the trim-lengths at some future time) is much more convenient if the trim-lengths are not permanently glued together as a pre-made sub-assembly.

Figure 15:
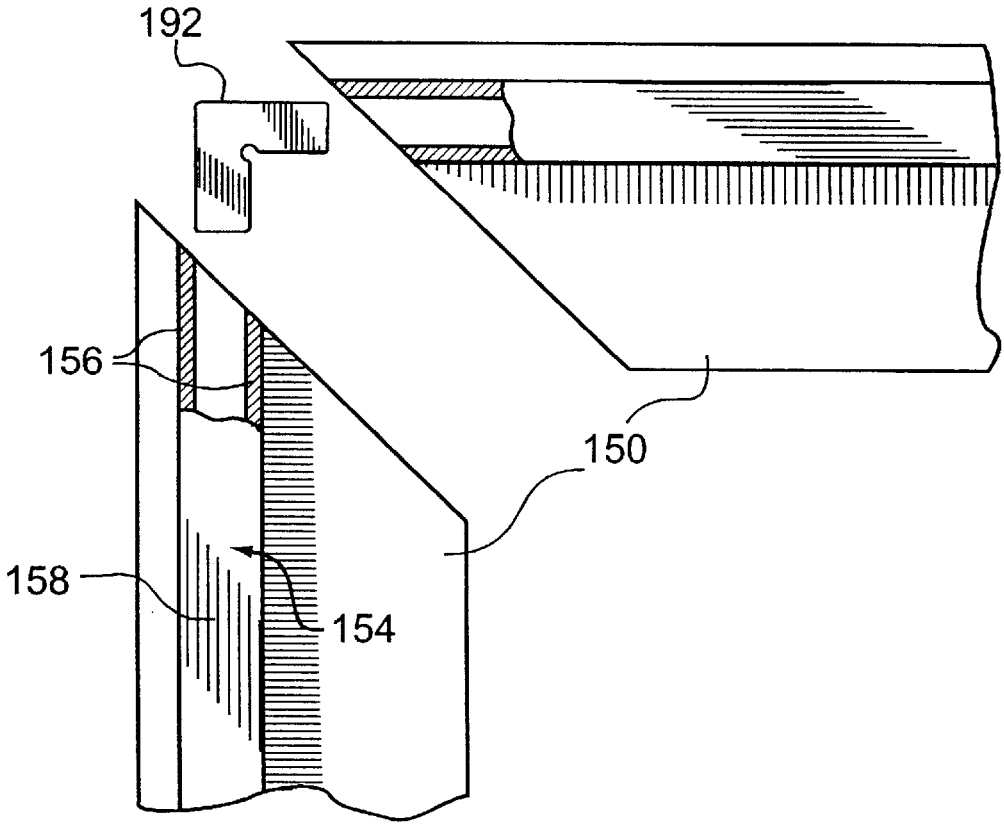
FIG. 15 shows a mitred corner between two spline strips.

Catering for possible protrusion-mismatch between mitred spline-strips is very simple, in view of the hollow-box profile of the spline-strip. As shown in FIG. 15, injection-moulded plastic corner-pieces 192, having a rectangular form which fits the hollow interior of the spline 154, are inserted into the splines at the mitred corners. When the spline-strips 150 are screwed or nailed to the wall, the corner-pieces 192 constrain and hold the two spline-strips at the same protrusion level, even if the wall should be (slightly) uneven.

The corner-pieces 192 may serve in this way equally for door trim as for window trim.

More than one spline or rib may be provided on the strip, having also a hollow interior, and corresponding corner pieces may be provided for that also.

A preferred way of installing the trim and its mounting system may be described as follows. The lengths of trim, the spline-strips, and the door-jamb-pieces, are all, pre-mitred, and pre-finished, in-factory, and are purchased by the installer as a kit for a particular width of door, or door opening. The kit is opened in the room, and the door-jamb-pieces are assembled, on edge, on the floor. The spine-strips for the inside of the room are assembled to the door-jamb pieces; the ribbed protrusions 163 are entered into the groove 167 while the jamb-pieces are still laid on the floor.

The door-jamb pieces may now be secured together at the mitred corners, using appropriate fasteners. (Of course, these fasteners should be so arranged as not to be visible after installation.)

The assembly comprising the fixed-at-the-corners jamb-pieces and the inside-the-room spline-strips, which are already assembled to the jamb-pieces, may now be lifted off the floor of the room, and the assembly placed in the door opening. The installer will generally be able to tell, by eye, by looking at the mitred corners, both of the jamb-pieces and of the spline-strips, whether the corners are accurately at right angles. It may be regarded that if the installer cannot see any out-of-squareness at the corner by looking at the line of the mitre, then the out-of-squareness is so small it can be ignored. Set squares and other instruments are generally not required. The installer must be able to "trust" the mitres for squareness, but this is acceptable with factory-made mitres.

The spline-strips are secured to the wall when the installer is satisfied, but looking at the lines of the mitres, that the corners are square. The door jamb-pieces are secured by securing the spline-strips to the wall. Once the inside-the-room spline-strips are secured, the outside-the-room spline-strips may be installed, using the grooves 167 cut in the far edges of the jamb-pieces. The outside-the-room spline strips are secured to the wall also.

The jamb-pieces and the spline-strips having been installed with accurately-square corners, in this manner, the lengths of wood trim may now be assembled to the splines.

The installer may be confident that the mitred corners of the wood trim will look square (and indeed will be square), provided the installer took a little trouble to ensure the mitred corners of the spline-strips looked square.

When installing the spline-strips and the wood trim in a case of renovation, rather than original installation, it will generally be impractical for the jamb-pieces to be provided with grooves 167. For renovation work, therefore, the spline-strip is provided without the protrusion 163.

Even though, for renovation, there is no protrusion-in-groove engagement between the jamb-pieces and the spline-strips, out-of-squareness of the door jamb can be accommodated (within limits) simply by the placement of the spline-strips. For renovation, the installer relies on looking at the line of the mitre to indicate when the spline-strips are square; he does not rely on the alignment of the strips with the existing door (or window) jamb. The installer looks at the line of the mitre (a distance of about 8.5 cm if the spline-strips are 6 cm wide) and makes sure the mitre line appears to be the same thickness all along its length. With only a minimal skill, the installer can fix the spline-trim with its corners square enough that the corners in the finished wood trim, when the wood trim comes to be pressed onto the splines, appear to be perfectly aligned.

Figure 16:
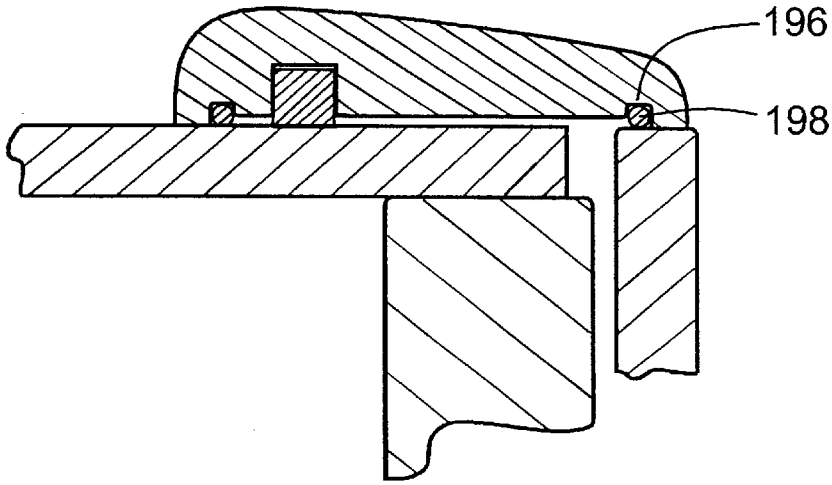
FIG. 16 shows trim to which draft-excluding seals have been added.

FIG. 16 shows a useful variation to the trim, in which further grooves 196 are provided in the cut-profile of the trim. Rubber sealing strips 198 are carried in the grooves 196, and serve to prevent drafts which may be emanating from inside the (hollow) wall and from the space 174, from leaking around the trim.

Figure 17:
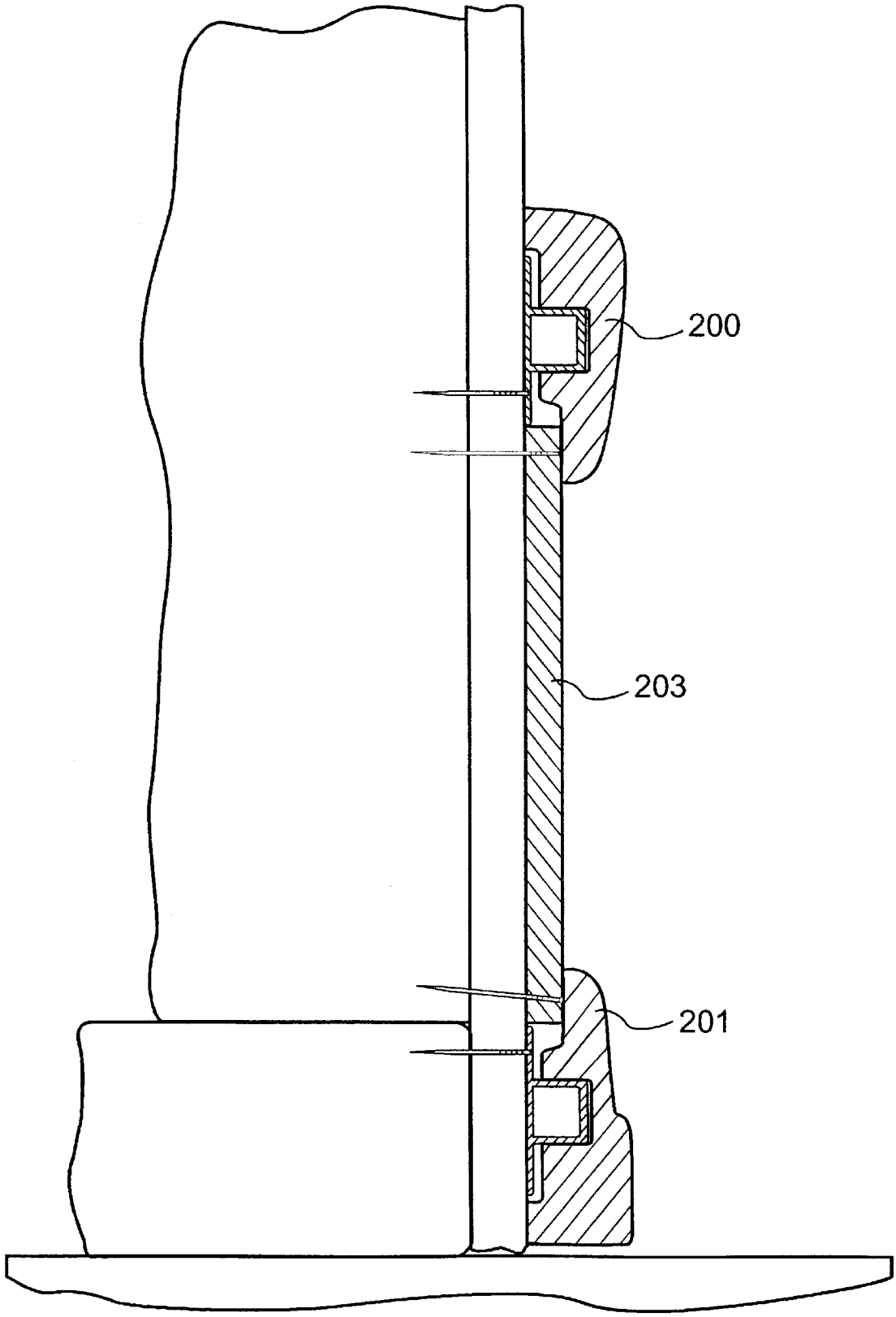
FIG. 17 is a cross-section of a baseboard, showing the manner of attachment.

FIG. 17 shows another manner in which the invention may be applied: for wide trim, such as may be required for a baseboard, the trim may be provided in, for example, three sections. The outer two sections 200,201 are attached by means of the spline attachment system of the invention, whereas the middle section 203 is screwed in place. Normally, the screws holding the middle section remain concealed by the outer two sections. When decorating the room, the outer two sections, being spline-held, can be removed. A similar arrangement may be employed also for crown moulding trim, ie trim for the corner between wall and ceiling, as in FIG. 11.

A trim attachment system that uses some of the principles as described above, but which employs two splines, will now be described.

The trim assembly 220 as shown in FIG. 18 is secured to the flat plane surface 223 of the wall around a door frame. The wall-surface 223 is the surface of a piece 224 of plaster-board, in this case, which is secured over a door-frame-stud 225. A door-side-jamb 226 is secured to the door-frame-stud 225, through spacing shims (not shown), in the conventional manner.

Figure 19B:
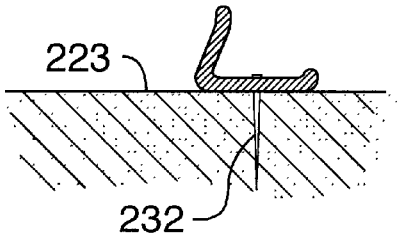
Figure 20B:
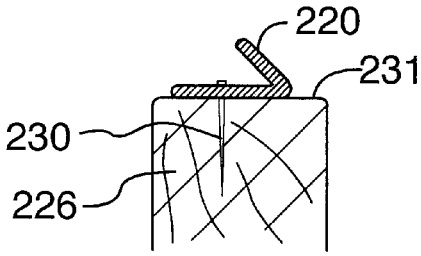

The trim assembly 220 includes a section 227 of straight-spline (the profile of which is shown in FIGS. 19*a*,19*b*), a piece 228 of solid wood trim, and a section 229 of angled-spline (FIGS. 20*a*,20*b*).

The angled-spline 229 is a plastic extrusion, and is of the same cross-sectional profile along its length. The angled-spline 229 is secured to the door-side-jamb 226 by means of staples 230 inserted every 15 cm or so.

The straight-spline 227 also is a plastic extrusion, and is of the same cross-sectional profile along its length. The straight-spline 227 is secured to the door-frame-stud 225, through the palster-board 224, by means of staples 232 inserted every 15 cm or so.

The trim 228 has an over-surface 234 and an under-surface 235. (All the under-surface 235 is invisible when the trim 228 is assembled to the wall 223.) A straight-groove 236 and a angled-groove 237 are cut into the under-surface 235.

The profile of the angled-spline 229 is shown in FIGS. 20*a*, 20*b*. The profile includes a leg 238, which lies at an angle to a foot 239. The foot 239 in this case is slightly arched, concavely with respect to the wall, as shown. When the angled-spline 229 is stapled to the door-side-jamb 226, the arched foot 239 is flattened. This has the effect of driving the toe 240 and heel 242 of the foot 239 into firm contact with the surface 231 of the door-side-jamb 226. When the angled-spline 229 has been stapled in place, the angled leg 238 lies upstanding. The fact that the heel 242 and toe 240 have been pressed firmly into contact against the surface 231 of the door-side-jamb 226 means that the angled-spline 229 cannot rock or twist or be otherwise unstable, but lies firmly and rigidly secured to the door-side-jamb.

The leg 238 protrudes a distance of about 5 mm from the surface of the door-side-jamb 226. After installation of the spline, the leg 238 is angled over at an angle of between 70 and 72 degrees to the surface 223 of the wall. An angle of less than about 65 degrees would be too steep, and an angle of more than about 75 degrees would not give enough inwards wedging action.

The angled-groove 237 in the under-surface 235 of the trim 228 has a angled-wall 243, which corresponds to the leg 238. The arrangement of the angled-groove 237 and the angled-spline 229 is such that, when the angled-groove is assembled over the angled-spline, and pushed into the angled-spline such that the angled-wall 243 of the groove engages the leg 238 of the angled-spline, so the action of pushing the groove towards the spline has the effect, by wedge action, of creating a force on the trim 228 which urges the trim into closer contact with the door-side-jamb 226. The leg 238 of the angled-spline 229 and the angled-groove 237 are so arranged also that, for assembly, the piece 228 of wood trim can be engaged to the spline while at an angle, as shown in FIG. 21.

For assembly of the trim, the angle of the piece 228 of trim is such that the under-surface 235 of the trim lies clear of the straight-spline 227, as the angled-groove 237 is being placed over the leg 238 of the angled-spline 229. Using the fingers, a person can drive the angled-groove 227 down into full contact with the leg 238, with the trim still at the angle as shown in FIG. 21.

Once the right end of the trim is fully engaged onto the angled-spline, the left end of the trim can be pressed down onto the straight-spline 227. To fully engage the trim tight against the wall surface, it may be necessary to knock or tap the trim into place. A straight-wall 245 of the straight-groove 236 lies substantially at a right angle with respect to the wall surface 223. The trim and the splines are arranged so that, when the trim is fully engaged into the angled-groove, the upstanding leg 246 of the straight-spline 227 is tight against the straight-wall 245 of the straight-groove 236.

As shown in FIG. 21, the straight-wall 245, as manufactured, has a lead-in chamfer 247, to facilitate entry of the leg 246 of the straight-spline 227 into the straight-groove 236. (Alternatively, or in addition, a lead-in chamfer or other form may be provided on the leg 246 of the straight-spline.)

As shown in FIG. 19*a*, the foot 248 of the straight-spline 227 is slightly arched concavely with respect to the wall surface 223. When the foot 248 is stapled to the door-frame-stud 225, the foot 248 becomes flattened, and the heel 249 and toe 250 are driven into firm, stable contact with the wall surface.

Also, as the arch of the foot 248 becomes flattened, the angle of the leg 252 changes. As shown in FIG. 19*b,* when the arched foot 248 is flattened, the angle 253 the leg 252 makes with the wall surface 223 decreases; or in other words, the tip 254 of the leg 252 of the straight-spline 227 is deflected a small distance to the right, i.e in the direction towards the angled-spline 229. Thus, the deflection of the leg 252 of the straight-spline, which results from flattening the arch of the foot 248, causes the leg 252 to press all the more tightly against the straight-wall 245 of the straight-groove 236 (FIG. 21).

The manner in which the splines and trim are assembled around the door frame will now be described. First, the installer must ensure that the lintel pieces of the trim assembly are aligned at perfect right angles to the side jamb pieces. With mitred corners, even a slight angular misalignment can be visibly obtrusive. The trim assembly as described enables even an amateur craftsman to install perfectly aligned trim mitres, with a minimum of skill and care.

Generally, the installer will proceed to install the angled-spline first, positioning it to give the desired visible margin or reveal, 258 (FIG. 24). The angled-spline 229 and the straight-spline 227 being physically-separate pieces, it is of course very important that the installer should install the angled-spline and the straight-spline exactly the correct distance apart, and exactly parallel. This task is facilitated by the use of a template 259, as shown in FIG. 22.

The template 259 comprises a short piece of the same solid wood trim as the piece 228. A slot 260 is cut in the template. After the angled-spline 229 has been fixed in place on the door-side-jamb 226, the straight-spline 227 is placed alongside. The template 259 is assembled over the angled-spline 229, and the installer, by finger pressure, presses the leg 252 of the straight-spline 227 against the straight-wall 245 of the straight-groove 236 of the template 259. The installer then inserts the staple 232 into the foot 248 of the straight-spline 227.

As mentioned, the action of driving home the staple 232 serves to flatten out the arched foot 248 of the straight-spline, and to cause the leg to deflect a little further towards the straight-wall 245. It has been found that, by careful manipulation of the template, that it is an easy matter for the installer to leave the straight-spline 227 exactly the right spacing distance away from the angled-spline, such that, when the wood trim 228 is later assembled, the leg 252 is a tight fit against the straight-wall 245.

It might be considered that, if the template 259, as used to set the spacing of the straight-spline relative to the angled-spline, is of the same cross-sectional profile as the trim 228 itself, the leg 252 will only just rest itself against the straight-wall 245; i.e the leg cannot be a tight fit against the straight wall. However, the fact that the foot 248 is arched or bowed means that, when the foot is flattened, the heel 249 area of the straight-spline rotates, and therefore the tip 254 of the leg 252 moves (i.e deflects) to the left, i.e to the position as shown in FIG. 19*b*. Thus, the tip 254 of the leg is left as a tight press fit against the wall 245 of the straight-groove 236, even though the template 259 is of exactly the same profile as the trim 228.

Forming the template from a piece of the trim is of course very simple. But the designer might be prepared to arrange that the template for installing the splines need not be of exactly the same profile as the wood trim itself. That is not so convenient, because the template would have to be cut specially, and tailored to the particular trim, but the benefit is that the distance between the angled-wall and the straight-wall, in the template, could be cut smaller than the distance between the angled-wall 243 and the straight wall 245 in the trim, thereby giving the designer more control over the magnitude of the force with which the leg 252 presses against the straight-wall 245 of the trim, after installation.

However, in most cases, the convenience of a template that can be simply cut from a piece of the trim itself, is preferred. In that case, also, the spacing of the two splines need not be standardised; the manufacturer of the trim can space the grooves to suit the configuration of the particular trim, and the spacing might be different on another configuration of trim, the templates.

The opposite walls of the grooves, i.e the wall of the angled-groove 237 opposite the angled-wall 243 and the wall of the straight-groove 236 opposite the straight-wall 245, are cut so as to make sure they have no contact with the legs 238,252 of the splines. Similarly, the roofs of the grooves are cut so as to be clear of contact with the legs.

The force required to keep the trim securely fixed against the wall can be quite considerable, whereby considerable stresses are induced in the portion of the profile of the piece 228 of solid wood trim that lies between the two grooves. However, in the arrangements of FIG. 18, these stresses are compressive, and solid wood is easily able to cope with stresses of this magnitude, if the stresses are compressive.

However, the designer might, in another case, wish to arrange the splines in such a manner that the portion of the wood profile between the two grooves was in tension, not compression. (In that case, the legs would press against the outside walls of the grooves, and not, as shown, against the inside walls of the grooves.) Putting the wood in tension is not preferred, since wood is liable to split, if stretched across the grain. The force between the splines and the grooves is large enough that the possibility of the wood splitting, if the stresses were tensile stresses, would be unacceptable.

It is recognised that only when the forces on the wood trim are very large—i.e large enough to possibly split the wood, if the stresses were tensile—are the forces great enough to hold the trim tightly enough for the attachment system to be acceptable in a real and practical sense, for a domestic installation. Of course, an attachment system that allowed the trim to fall off if the trim were knocked, would not be acceptable. Indeed, it may be regarded that the general rule is this, that if the trim can be removed by hand, i.e without tools, probably the attachment is not tight enough. In the present case, a person can expect to have to use a pry-bar to remove the pieces of trim from the splines.

Another benefit that arises from the fact that the foot of the straight-spline is arched, is that the heel 249 of the straight-spline, after stapling, is pressed firmly, with a positive force, against the wall surface 223. Because the heel is already firmly pressed against the wall surface, therefore, when the trim is pressed down onto the straight spline, the straight spline remains solid, and does not "give". If there were any resilience in the straight spline, then when the trim was released, after being pressed onto the spline, the trim might spring back. If that happened, an unsightly gap would open between the edge 257 of the trim and the wall surface 223.

By contrast, it is the wedging action of the angled-spline and groove that ensures the edge 256 of the trim remains tight against the surface 231 of the door-side-jamb 226. Such wedging action is not available from the straight spline, but the fact that the heel 249 is pressed tightly into the wall surface 223 also means that the edge 257 is not likely to spring open.

The edges 256,257 (FIG. 21) mark the division between the visible over-surface 234 of the trim and the invisible under-surface 235. The designer should make sure the under-surface 235 is relieved to the extent that it is only the actual edges 256,257 that touch the wall surface and jamb. The relief should be such that only these edges touch, even if the wall surface and the surface of the door-side-jamb should be misaligned. It should be noted that the surface of the door-side-jamb and the surface of the wall might not be exactly co-planar and in-line; that is to say, the door-side-jamb might protrude a small distance, say a millimetre or two, above (or below) the plane of the wall surface. The manner of attachment as described is able to cater for such misalignment of the surfaces, and still the edges 256,257 of the trim can be held tightly against the respective surfaces, with no gaps.

Of course there is a limit to the amount of misalignment that can be accommodated, particularly in the sense that the trim, being solid and rigid, cannot easily undergo twisting, in torsion. Therefore, if the surfaces are e.g rippled, unsightly gaps cannot be avoided. But usually, wall surfaces and door jamb surfaces are reasonably straight and flat, in themselves, and are not rippled. If there is a misalignment of the surfaces, it is that the surfaces are not quite co-planar, and the attachment system as described can cope with that kind of misalignment, leaving no visible gaps at either of the edges 256,257.

It should be noted that the edge 257 of the trim is held in place purely by the friction arising from the engagement of the tip 254 of the leg 252 against the straight-wall 245 of the trim. There is no snap-action or other mechanically-assisted grip. Snap-action would involve a resilient component being stretched and then settling back, whereby, with snap-action, at least some of the components have to be stressed, during assembly, beyond their designed working stress.

FIG. 23 shows that the leg of the straight-spline may be made, if desired, with a tip 254. This tip may be sharp enough that, over a prolonged period, the tip will make a slight indentation into the wooden surface of the wall 245; thus, a small relaxation of the load in the leg 252, if that should occur, may be compensated by a digging-in of the sharp tip.

It should be noted that the force on the wood trim is spread evenly all along the length of the trim, and is not applied at local points. The forces holding the splines 227,229 in place are derived from the staples 230,232, and are therefore concentrated and local. The splines are plastic extrusions, and are not completely rigid, and inevitably, the profile of the spline near a staple will be (slightly) different from the profile between staples. However, this is not important, in that the wood trim is much more rigid than the splines, and the wood trim will force the splines to conform to the shape as dictated by the grooves in the trim. Thus, the splines, after assembly of the trim thereto, will inevitably exert different forces on the grooves, at different points along the length of the splines—not only because of the local distortions caused by the staples, but also because the installer will not get the splines exactly accurate as to position. It is recognised that this does not matter, because the trim is comparatively much more rigid that the splines, and will draw the splines into conformance, with only a slight increase, locally, in the force between the spline and the groove.

It is important that the spacing of the two splines be accurate. If the spacing were too large, the leg 252 would not press tightly enough against the straight-wall 245, and the trim would then not be secured firmly; if the spacing were too small, the tip 254 of the leg would not enter properly into the lead-in chamfer 247. It is recognised, in the invention, that there is an adequate margin between "too large" and "too small", in this sense; that is to say, it is recognised that a structurally separate angled-spline and straight-spline can co-operate functionally together, given the inherent limitations as to the dimensions and materials of the components and as to the level of care and skill that can be expected from a typical installer. It has been found that with the use of the trim attachment system as described, it can be expected that the trim will be attached to the wall with an adequate degree of firmness, such as to resist the (small) knocks etc the trim will inevitably receive in a typical household. Also, the trim attachment system is such that the trim can be readily removed and replaced, for such purposes as re-decorating. Removal is effected by prying the trim off the splines, the splines being left in place.

As mentioned, a template may be used to aid in the accurate fixing of the splines around the frame opening. If this template can be made from a piece of the actual trim that is to be used, so much the better, and it has been described how, because of the arched foot of the spline profile, the actual trim can indeed be used as the template, leaving the splines set, after assembly, to exert a tight squeeze on the trim.

However, sometimes the designer may prefer to make use, during installation of the splines, of a template of a profile that is different from that of the actual trim. Let the distance between the straight-wall 245 and the angled-wall 243, on the trim, be D; if the template is to be specially manufactured, the corresponding distance on the template can be manufactured to D minus a small amount. When the splines are installed using this template, therefore, the trim will assuredly be gripped tightly between the legs of the splines.

In order to secure perfect mitred corners, it is preferred to pre-weld lengths of spline together. For example, a right-angle corner piece may be made from two lengths of the straight-spline, welded along the mitre angle. The two lengths may be 20 or 30 cm long. Two pre-welded right-angle corner-pieces are stapled into place, one either side of the opening. The rest of the lengths of straight-spline are then installed, taking their alignment and position from the right-angle pieces. Only one of the splines need be made with right-angle corner-pieces.

An alternative to the use of pre-manufactured corner-pieces is the use of a jig, which has slots to ensure the pieces of the spline are aligned exactly correctly, prior to their being fastened to the wall.

As shown in FIG. 24, the leg and the foot of the angled-spline may be angled obtusely.

As shown in FIG. 25, the angled-spline and the straight-spline may be reversed, with respect to the position of the trim around the frame.

As mentioned, the trim is of solid wood. This expression should be understood to include composite trim, such as that manufactured from compressed or extruded wood particles. Such composite trim is often covered with a veneer of a decorative wood. The important point about the trim, and the manner of installation as depicted herein, is that the material of the trim is prone to cracking, and splitting, if overstressed. Trim made of hollow plastic, for example, or hollow metal, behaves quite differently, when highly stressed, from trim made of solid wood. Wood trim cannot be expected to be robust enough unless it has solid bulk, and is quite rigid.

The splines preferably are made as plastic extrusions. Alternatively, the splines may be of metal, e.g aluminum, extrusions, or the splines may be made as rolled-steel profiles.

It has been mentioned that the splines should be stapled to the frame piece and the wall. Other fasteners may be used, such as nails, screws, etc.

The undersurface 235 of the trim is concave, to ensure that only the edges 256,257 actually touch the wall and frame surfaces. The degree of concavity is such as to allow for mismatch of the surface of the frame piece relative to the surface of the wall, being enough to ensure that, even if the surfaces are imperfectly formed, for example if the edge of the plaster-board should be damaged, with burrs standing out a little from the surface (which often happens), that there is enough hollowness under the trim to accommodate the same. Preferably, the degree of concavity is enough to accommodate electrical wiring, within the hollowness.

The trim-attachment system, as described, may be installed around door-frames, window-frames, and trim generally. The system is also suitable for baseboards.

What is claimed is:

1. Wood trim apparatus, in combination with a framed opening in a wall, the wood trim apparatus being suitable for fitment to the wall around the framed opening, wherein:

the combination includes a frame-piece, which is marginally contiguous with the framed opening;

the frame-piece has a plane surface, which is at least approximately co-planar with the flat plane surface of the wall;

the apparatus includes a piece of trim, of solid wood;

the wood trim includes, as to its cross-sectional profile, an over-surface, which comprises all the surface of the trim that is visible when the trim is installed on the wall around the opening, and includes an under-surface, which comprises all the surface of the trim that is not visible when the trim is so installed;

the wood trim includes two parallel grooves formed into the under-surface, being a straight-groove and an angled-groove;

the profile of the wood trim is such that the visible over-surface meets the invisible under-surface at an angled-groove-edge near the angled-groove, and at a straight-groove-edge near the straight-groove;

the apparatus includes a straight-spline, which, as to its cross-sectional profile, includes a foot that is structurally suitable for attachment to one of the plane surfaces, and is so configured, that, when the foot is attached to the plane surface, a leg of the straight-spline stands protruding away from the plane surface;

the apparatus includes an angled-spline, which, as to its cross-sectional profile, includes a foot that is structurally suitable for attachment to the other of the plane surfaces, and is so configured, that, when the foot is attached to the plane surface, a leg of the angled-spline stands protruding away from the plane surface;

the straight-groove includes a straight-wall, and the straight-groove is formed in the wood trim at such an angle that, when the wood trim is placed flat against the wall, the straight-wall of the straight-groove lies substantially at right angles to the flat plane surface of the wall;

the angled-groove includes an angled-wall, and the angled-groove is formed in the wood trim at such an angle that, when the wood trim is placed flat against the wall, the angled-wall of the angled-groove lies at an angle, which is substantially not a right angle, to the flat plane surface of the wall;

the straight-spline and the angled-spline are attached, one to the flat plane surface of the wall and the other to the plane surface of the frame-piece, and the spacing of the attached splines, and the shapes and angles of the protruding legs thereof, are such that contact points on the legs make forceful contact respectively with the straight-wall and the angled-wall;

the grooves are deep enough that, and the under-surface of the wood trim is relieved enough between the said two edges that, the wood trim can fit over the splines with the said two edges in contact with the respective plane surfaces;

the angle of the angled-wall is such that the said forceful contact between the angled-wall of the angled-groove and the leg of the angled-spline creates a force urging the angled-groove-edge of the wood trim in the direction towards the plane surface to which the angled-spline is attached.

2. Apparatus of claim 1, wherein the arrangement of the splines and grooves is such that the forceful contact between the walls of the groove-walls and the legs of the splines acts in a direction to put that portion of the wood trim that lies between the grooves under compressive stress.

3. Apparatus of claim 1, wherein the arrangement of the splines and grooves is such that, for assembly of the trim onto the splines, a person, by hand manipulation, can:

first engage the angled-groove over the angled-spline;

then push the wood trim laterally onto the leg of the angled-spline, thereby deepening the engagement of the angled-groove over the angled-spline;

then rotate the wood trim to engage the straight-groove over the straight-spline;

and then press the wood trim in the direction towards the wall, thereby deepening the engagement of the straight-groove over the straight-spline.

4. Apparatus of claim 1, wherein:

the arrangement of the splines and grooves is such that, with the angled-groove fully engaged over the angled-spline, the straight-groove can be engaged over the straight-spline without snap-action;

whereby, in respect of the contact force between the points on the legs and the walls of the grooves, the contact force created during assembly of the trim to the splines substantially does not exceed the residual contact force, after assembly.

5. Apparatus of claim 1, wherein the under-surface of the wood trim is relieved enough, between the said two edges, that the wood trim can fit over the splines with the said two edges in contact with the respective plane surfaces, even when the plane of the wall is displaced 1 mm from the plane of the frame piece.

6. Apparatus of claim 1, wherein, in respect of at least one of the splines:

the foot of the spline has a toe and a heel, and the leg protrudes from the foot at a point close to the heel;

the foot of the spline is arched, to the extent that when the foot is placed against the plain surface, at first only the toe and heel make contact with the surface;

the apparatus includes a fastener, and the fastener passes through the foot, and into the surface, and the fastener engages the material of the surface forcefully enough that the arched foot lies flattened against the surface;

whereby the act of fastening the arched foot to the surface, in causing the arched foot to flatten, is effective thereby to cause the leg to rotate angularly about the heel, in the direction towards the toe.

7. Apparatus of claim 6, wherein the arrangement of the splines is such that the act of fastening the arched foot to the surface, in causing the arched foot to flatten, is effective thereby to cause the leg to rotate angularly about the heel, in the direction towards the other of the splines.

8. Apparatus of claim 1, wherein, in respect of the angled-spline, the leg makes an acute angle with the foot.

9. Apparatus of claim 1, wherein, in respect of the straight-spline, the point of contact between the leg and the straight-wall of the straight-groove is on the opposite side of the leg from the foot.

10. Apparatus of claim 1, wherein, in respect of the angled-spline, the point of contact between the leg and the angled-wall of the angled-groove is on the opposite side of the leg from the foot.

11. Apparatus of claim 1, wherein the pieces of wood trim, and the two splines, are each of constant cross-sectional profile along their lengths.

12. Apparatus of claim 1, wherein the two splines are physically separate plastic extrusions.

13. Apparatus of claim 1, wherein the angled-spline is attached to the frame-piece, and the straight-spline to the wall.

14. Apparatus of claim 1, wherein the angle of the angled-wall of the angled-groove is between about 65 and 75 degrees to the wall.

15. Apparatus of claim 14, wherein the angle is between 70 and 72 degrees.

* * * * *